US008813371B2

(12) United States Patent
Dewberry

(10) Patent No.: US 8,813,371 B2
(45) Date of Patent: Aug. 26, 2014

(54) BLADE PROTECTOR FOR CUTTING TOOLS

(75) Inventor: Andrew Dewberry, Vancouver (CA)

(73) Assignee: Vancouver Tool Corporation, Vancouver (CA)

( * ) Notice: Subject to any disclaimer, the term of this patent is extended or adjusted under 35 U.S.C. 154(b) by 528 days.

(21) Appl. No.: 12/896,665

(22) Filed: Oct. 1, 2010

(65) Prior Publication Data

US 2011/0271456 A1 Nov. 10, 2011

Related U.S. Application Data

(60) Provisional application No. 61/330,879, filed on May 4, 2010.

(51) Int. Cl.

| | |
|---|---|
| ***B67D 7/30*** | (2010.01) |
| ***B26D 3/16*** | (2006.01) |
| ***B26D 7/22*** | (2006.01) |

(52) U.S. Cl.

CPC *B26D 3/166* (2013.01); *B67D 7/30* (2013.01); *B26D 7/22* (2013.01); *B26D 3/169* (2013.01)

USPC ..... 30/278; 30/286; 30/288

(58) Field of Classification Search

USPC ..... 30/284, 285, 278, 286, 113, 287, 288; 131/253, 233

See application file for complete search history.

(56) References Cited

U.S. PATENT DOCUMENTS

| | | | | |
|---|---|---|---|---|
| 1,803,880 | A * | 5/1931 | Tatham | 30/279.6 |
| 4,106,196 | A * | 8/1978 | Smithline | 30/294 |
| 4,328,910 | A | 5/1982 | Polite, Jr. | |
| 4,382,330 | A * | 5/1983 | Harbaugh | 30/124 |
| 4,493,437 | A | 1/1985 | Breeden | |
| 4,742,616 | A | 5/1988 | Lippert | |
| 4,802,607 | A | 2/1989 | Johnson | |
| 4,837,931 | A | 6/1989 | Beermann | |
| 4,928,424 | A | 5/1990 | Campanelli et al. | |
| 5,675,860 | A | 10/1997 | Campbell | |
| 5,815,925 | A | 10/1998 | Chang | |
| 5,860,568 | A | 1/1999 | Mallalieu et al. | |
| 5,992,022 | A * | 11/1999 | Carrera Moya | 30/113 |
| 6,045,005 | A | 4/2000 | Stratton | |
| 6,056,156 | A | 5/2000 | Peng | |
| 6,216,346 | B1 * | 4/2001 | Wechsler | 30/113 |
| 6,527,545 | B2 | 3/2003 | Cook | |
| 7,308,897 | B2 | 12/2007 | Russell, II et al. | |
| 7,418,785 | B2 | 9/2008 | Whitemiller et al. | |
| 2010/0146792 | A1 * | 6/2010 | Wong | 30/113 |
| 2010/0162569 | A1 * | 7/2010 | Smith | 30/113 |

FOREIGN PATENT DOCUMENTS

| | | | |
|---|---|---|---|
| GB | 2457346 | A2 | 8/2009 |
| WO | 2008022143 | A1 | 2/2008 |

* cited by examiner

*Primary Examiner* — Omar Flores Sanchez

(74) *Attorney, Agent, or Firm* — Oyen Wiggs Green & Mutala LLP

(57) ABSTRACT

A cutting tool comprising a body, an aperture defined through the body, a blade coupled to the body, and at least one protrusion extending from the body into the aperture. The blade has a cutting edge extending into the aperture. The protrusion (s) has(have) an end portion proximate the cutting edge and configured to impede access to the cutting edge. The protrusion(s) may be flexible, such that limited access to the cutting edge is permitted in a flexed state.

49 Claims, 24 Drawing Sheets

BLADE PROTECTOR FOR CUTTING TOOLS

REFERENCE TO RELATED APPLICATION

This application claims priority from U.S. Provisional Patent Application No. 61/330,879 filed 4 May 2010 entitled "BLADE EDGE SAFETY PROTECTOR AND GUIDE". For the purposes of the United States of America, this application claims the benefit of U.S. Provisional Patent Application No. 61/330,879 filed 4 May 2010 entitled "BLADE EDGE SAFETY PROTECTOR AND GUIDE" under 35 USC §119.

TECHNICAL FIELD

The invention relates to blade protectors for cutting tools. Certain embodiments provide tools adapted for cutting dispensers having sealed and closed dispensing tips of the kind used for containing and dispensing curable materials such as caulking or other sealants.

BACKGROUND

Curable materials such as sealants, caulking and adhesives are generally distributed in and dispensed from cylindrical or otherwise shaped material dispensers having tapered nozzles which are initially closed and sealed. The ends of these nozzles must be opened prior to any product being dispensed from the material dispensers.

The ends of such dispensing nozzles are often cut with general purpose cutting tools such as knives or scissors. Use of such tools to cut the end of a nozzle can be imprecise and inconvenient. Also, use of such tools can be hazardous as the blades are generally unprotected.

There exist a variety of dedicated tools for use in cutting the nozzles of dispensers. For example, U.S. Pat. No. 7,418,785 to Whitemiller et al. describes a compact dispensing tube opener for accessing contents of a dispensing tube having a dispensing tip and an inner seal. A cutting utility is mounted for linear movement in a passageway of the housing and engaged by movement of a user to cut a dispensing tip. The cutting end is not protected while passing through the passageway as it must cut through the object, a dispensing tip, in the passageway. This unprotected cutting end could pose a hazard to users.

Other examples of cutting tools include:

U.S. Pat. No. 7,308,897;
U.S. Pat. No. 6,056,156;
U.S. Pat. No. 6,045,005;
U.S. Pat. No. 5,860,568;
U.S. Pat. No. 5,815,925;
U.S. Pat. No. 4,837,931;
U.S. Pat. No. 4,802,607;
U.S. Pat. No. 4,742,616;
U.S. Pat. No. 4,493,437;
U.S. Pat. No. 4,328,910;
U.K. Patent Application Publication No. GB 2 457 346; and,
PCT Patent Application Publication No. WO 2008/022143.

The inventor has determined a need for improved cutting tools wherein the blade is protected.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect provides a cutting tool comprising a body, an aperture defined through the body, a blade coupled to the body, and at least one protrusion extending from the body into the aperture. The blade has a cutting edge extending into the aperture. The protrusion(s) has(have) an end portion proximate the cutting edge and configured to impede access to the cutting edge. The protrusion(s) may be flexible, such that limited access to the cutting edge is permitted in a flexed state.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

One aspect of the invention provides a cutting tool having a protected blade or other cutting means. The blade is located in an aperture defined in a tool body and protected by one or more fins or other protrusions extending into the aperture to prevent a user's fingers from accessing the blade. The one or more fins may extend from an opposite side of the aperture as does the blade, and may be oriented generally perpendicularly to the blade. In some embodiments, a pair of flexible, resilient fins are provided which cooperate to urge a workpiece (such as, for example, a dispensing nozzle) wedged therebetween toward the blade.

Figure 1:
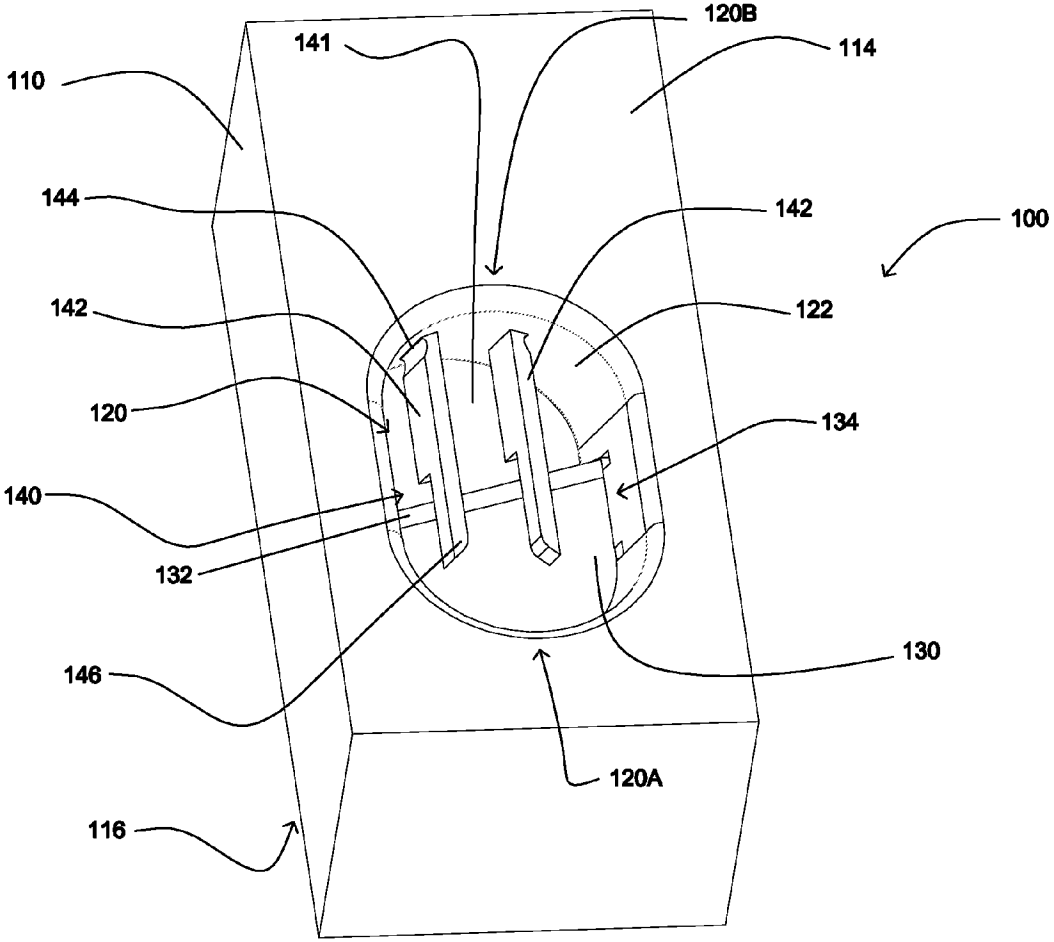
FIG. 1 is a perspective view of an example cutting tool with a protected blade according to one embodiment.

FIG. 1 shows a tool 100 according to an example embodiment. Tool 100 comprises a tool body 110 having an aperture 120 defined therethrough. Aperture 120 passes from a first or "upper" tool body surface 114 to a second or "lower" tool body surface 116. The terms "upper" and "lower", and any variations thereof, are used herein solely to facilitate description of example embodiments with reference to the directions shown in the drawings, and are not intended to necessarily require any particular real world orientation. Aperture 120 may be generally elongated in one direction, such that the distance between first and second ends 120A and 120B is greater than the distance between the intervening sides. In the illustrated example, aperture 120 is generally obround in shape, but it is to be understood that aperture 120 could also have different shapes.

A cutting means extends into aperture 120 for use in cutting a workpiece inserted through aperture 120. In the illustrated example, the cutting means comprises a blade 130 having a cutting edge 132. Cutting edge 132 is positioned to extend at least partially across aperture 120 (cutting edge 132 extends completely across aperture 120 in the illustrated embodiment). Blade 130 extends from an aperture wall 122 of tool body 110 at first end 120A of aperture 120. Blade 130 is held in place by a connection mechanism 134, as described further below. It is to be understood that blade 130 could be attached to body 110 at a different location or by a different mechanism in other embodiments. The angle of blade 130 may also be varied to facilitate different angled cuts of a nozzle. For example, in some embodiments, the walls of aperture 120 may be oriented generally perpendicularly to upper and lower surfaces 114 and 116 of tool body 110 and blade 130 may be oriented at a desired angle with respect to tool body 110. For example, blade 130 may oriented to be at a variety of rotational positions about an axis colinear with the length of tool 100 and/or about an axis perpendicular to the length of tool 100. In some embodiments, blade 130 may be adjustably mounted to tool body 110 such that the angular orientation of blade 130 may be adjusted.

One or more protrusions 140 are provided which extend into aperture 120 in order to impede access to cutting edge 132. In the illustrated embodiment, protrusions 140 comprise a pair of fins 142 extending from aperture wall 122 at second end 120B of aperture 120. Fins 142 are connected to aperture wall 122 by fin connections 144. In some embodiments, fin connections 144 may comprise small concavities as shown in FIG. 1 (not specifically enumerated) to reduce material stress during flexing of fins. In other embodiments such concavities may be omitted. Each fin 142 has an end portion 146 which is positioned proximate cutting edge 132. As best seen in FIG. 4, end portions 146 may each have a stepped profile comprising an upper portion 146A which extends past cutting edge 132 and a lower portion 146B which ends short of cutting edge 132. Fins 142 may each define a plane which is oriented generally perpendicularly to a plane defined by blade 130. Fins 142 may be formed from a flexible, resilient material. Fins 142 may be integrally formed with body 110 in some embodiments, or may comprise separate components attached to body 110 in other embodiments.

Figure 2:
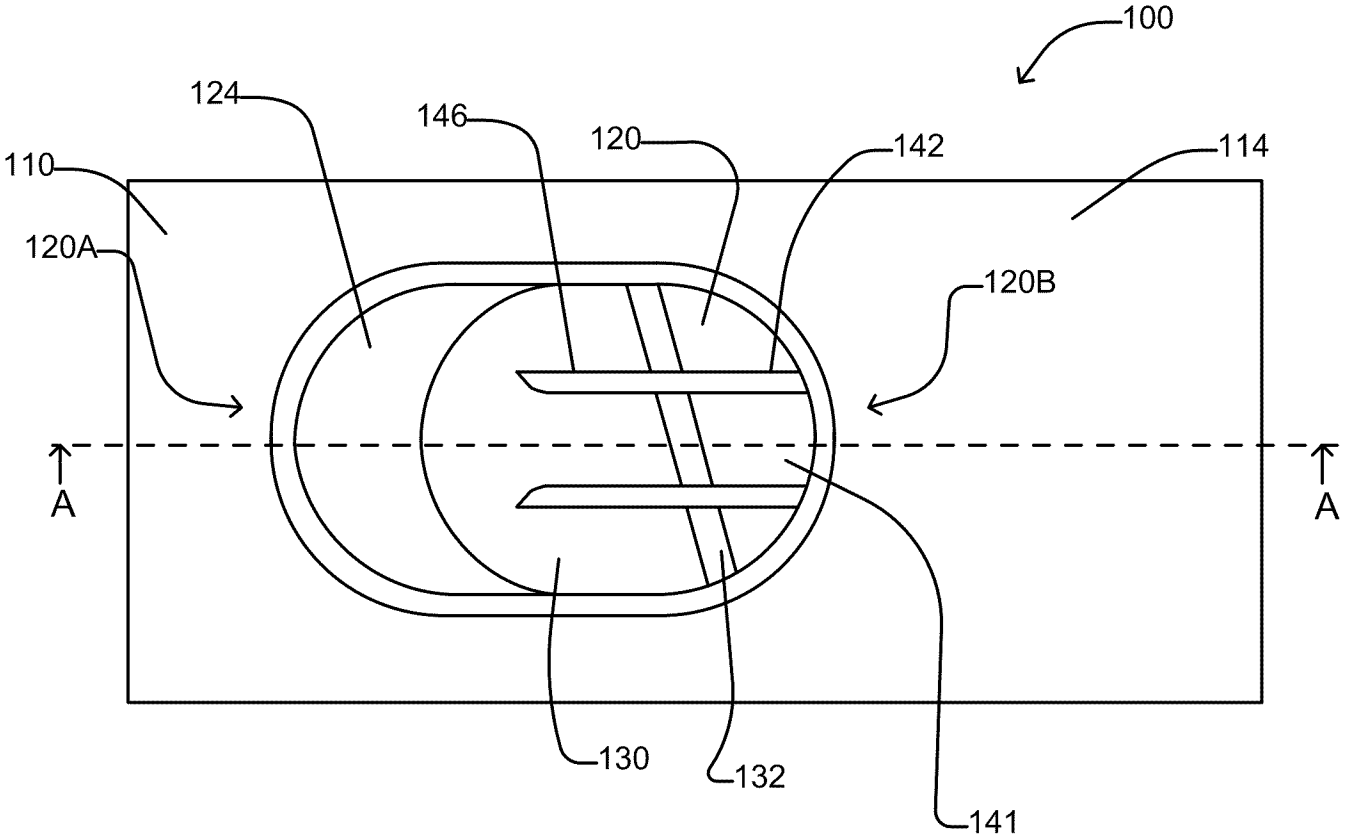
FIG. 2 is a top view of the tool of FIG. 1.
Figure 2A:
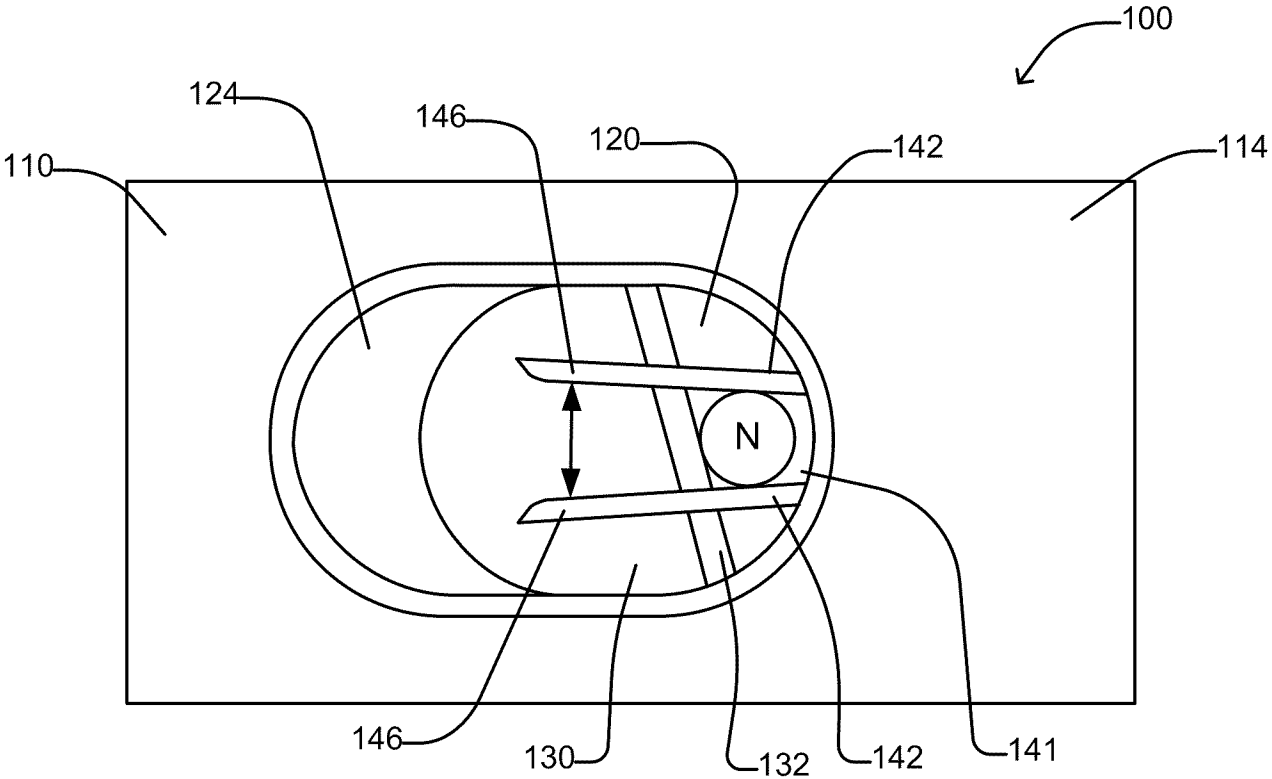
FIG. 2A shows the same view as FIG. 2 with the fins in a flexed state.

In the illustrated example, fins 142 define an opening 141 therebetween. In some embodiments, opening 141 may be about one quarter inch wide. Fins 142 are moveable between a rest state (as shown, for example, in FIG. 2) and one or more flexed states (as shown, for example, in FIG. 2A). Fins 142 are positioned such that when fins 142 are in the rest state, opening 141 is too small to allow a workpiece such as, for example, an end of a dispensing nozzle N (see FIG. 2A) to pass therethrough and access cutting edge 132. When fins 142 are in the rest state, a user's fingers also cannot access cutting edge 24. When nozzle N is forced between fins 142, end portions 146 of fins 142 are urged apart into a flexed state, as indicated by the double sided arrow in FIG. 2A, such that opening 141 is enlarged and nozzle N can be cut by cutting edge 132. Nozzle N may then be positioned by the user such that the desired portion can engage cutting edge 132 to effect a desired cut. In some embodiments, the resilient force of fins 142 on nozzle N stabilizes the nozzle N and urges nozzle N toward cutting edge 142 such that precise cuts are facilitated. In some embodiments, the resilient force of fins 142 when in a flexed state help force nozzle N against cutting edge 132. When fins 142 are in a flexed state as shown in FIG. 2A users' fingers are still prevented from accessing cutting edge 132 due to the presence of nozzle N.

Figure 3A:
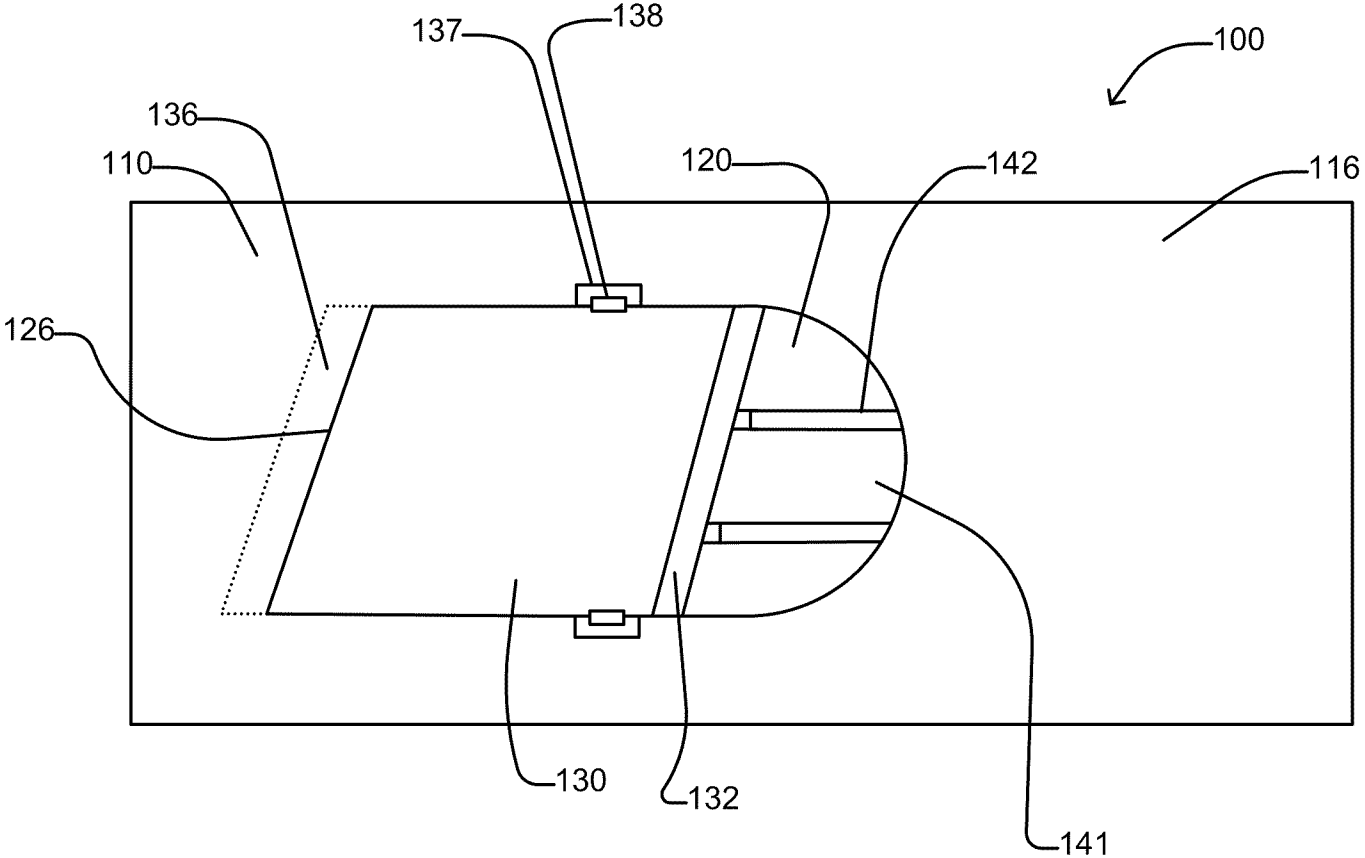
FIG. 3A is a bottom view of the tool of FIG. 1 illustrating an example blade connection mechanism.
Figure 4A:
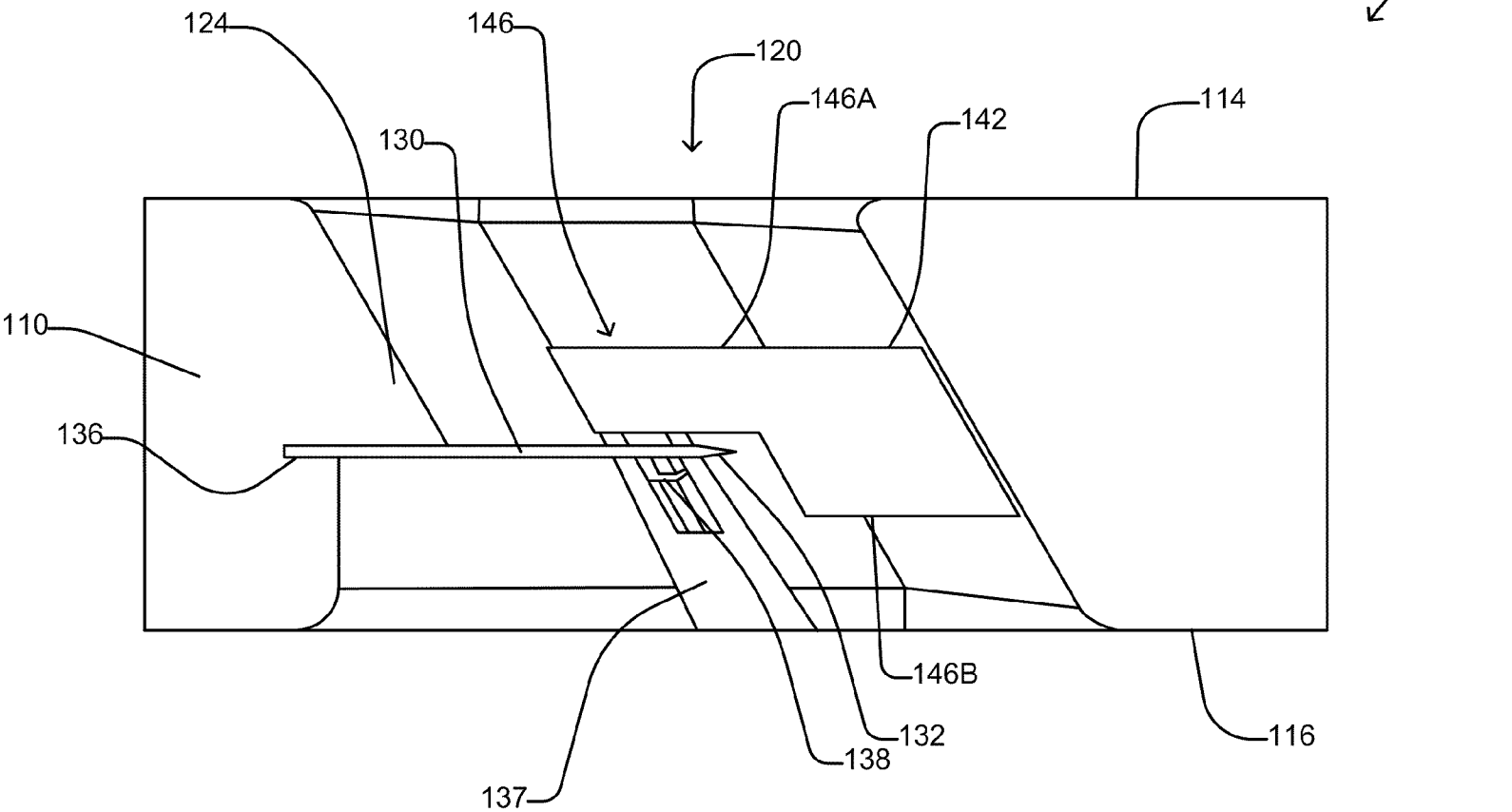
FIG. 4A is a sectional view taken along line A-A of FIG. 2 showing the blade connection mechanism of FIG. 3A.

FIGS. 3A and 4A illustrate an example connection mechanism wherein blade 130 is removably held in place in aperture 120 by a slot 136 and tabs 138. Tabs 138 may comprise a flexible, resilient material, and may be integrally formed with body 110 in some embodiments. Tabs 138 may be located in channels 137 to permit tabs 138 to be forced outwardly to remove blade 130. As shown in FIGS. 2 and 4A, an upper side of aperture 120 comprises an overlapping portion 124 at first end 120A which abuts an upper surface of blade 130 when blade 130 is in slot 136. As best seen in FIG. 3A, a lower side of aperture 120 has an end portion 126 configured to conform to the shape of the end of blade 130 opposite cutting edge 132.

In order to install blade 130 the end thereof opposite cutting edge 132 is inserted into slot 136, and then a portion of blade 130 proximate to cutting edge 132 is moved upwardly to be engaged by tabs 138 such that blade 130 is held in place. In some embodiments fins 142 prevent or substantially limit movement of blade 130 along a direction generally parallel to fins 142. If replacement of blade 130 is required, in order to remove blade 130 a user applies outward pressure to tabs 138 and presses blade 130 downwardly. Blade 130 may then be slid out of slot 136, and a new blade 130 can be installed. In other embodiments blade 130 may be permanently installed into tool 100 via an adhesive or other means.

Figure 3B:
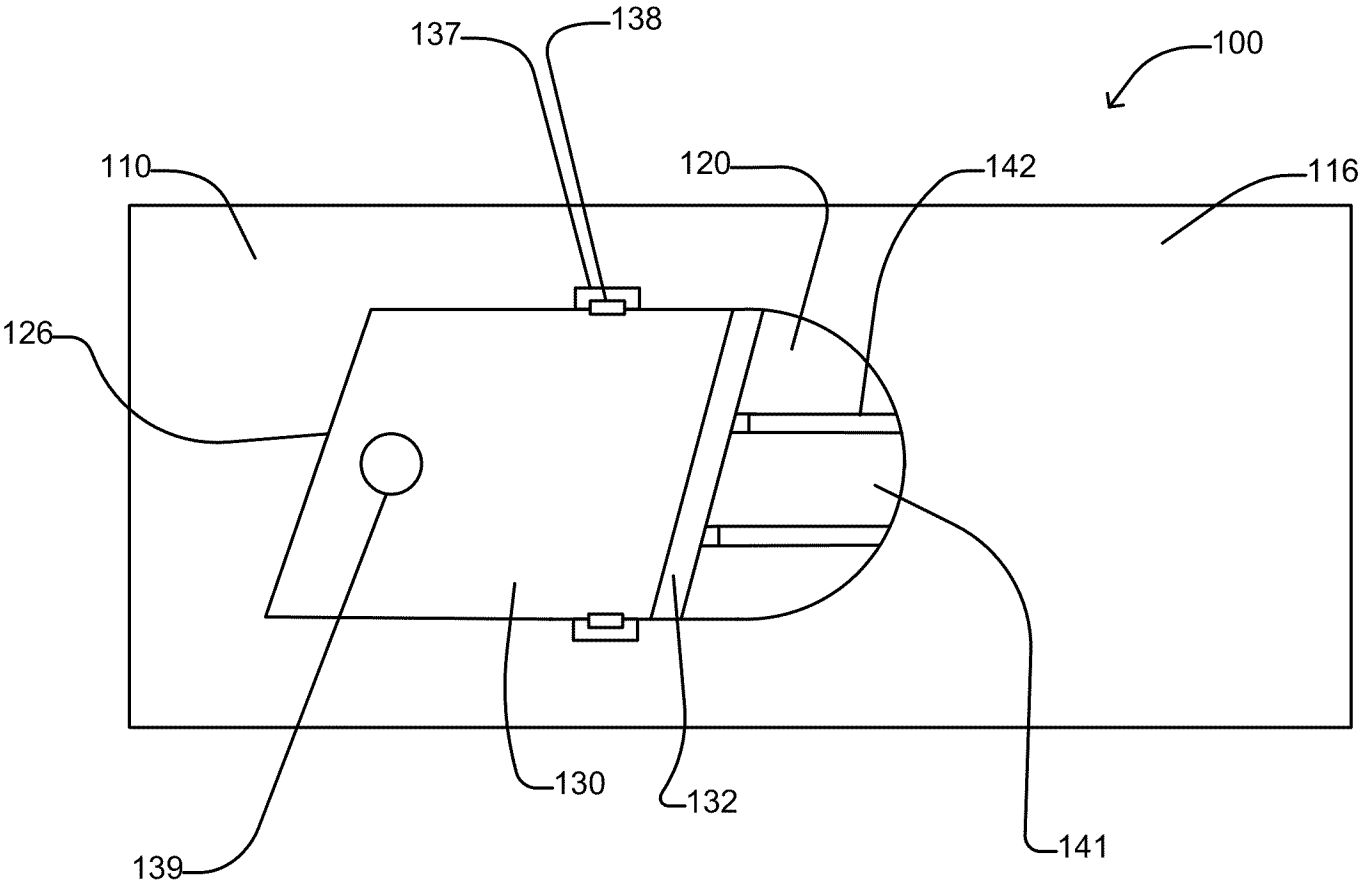
FIG. 3B is a bottom view of the tool of FIG. 1 illustrating another example blade connection mechanism.
Figure 4B:
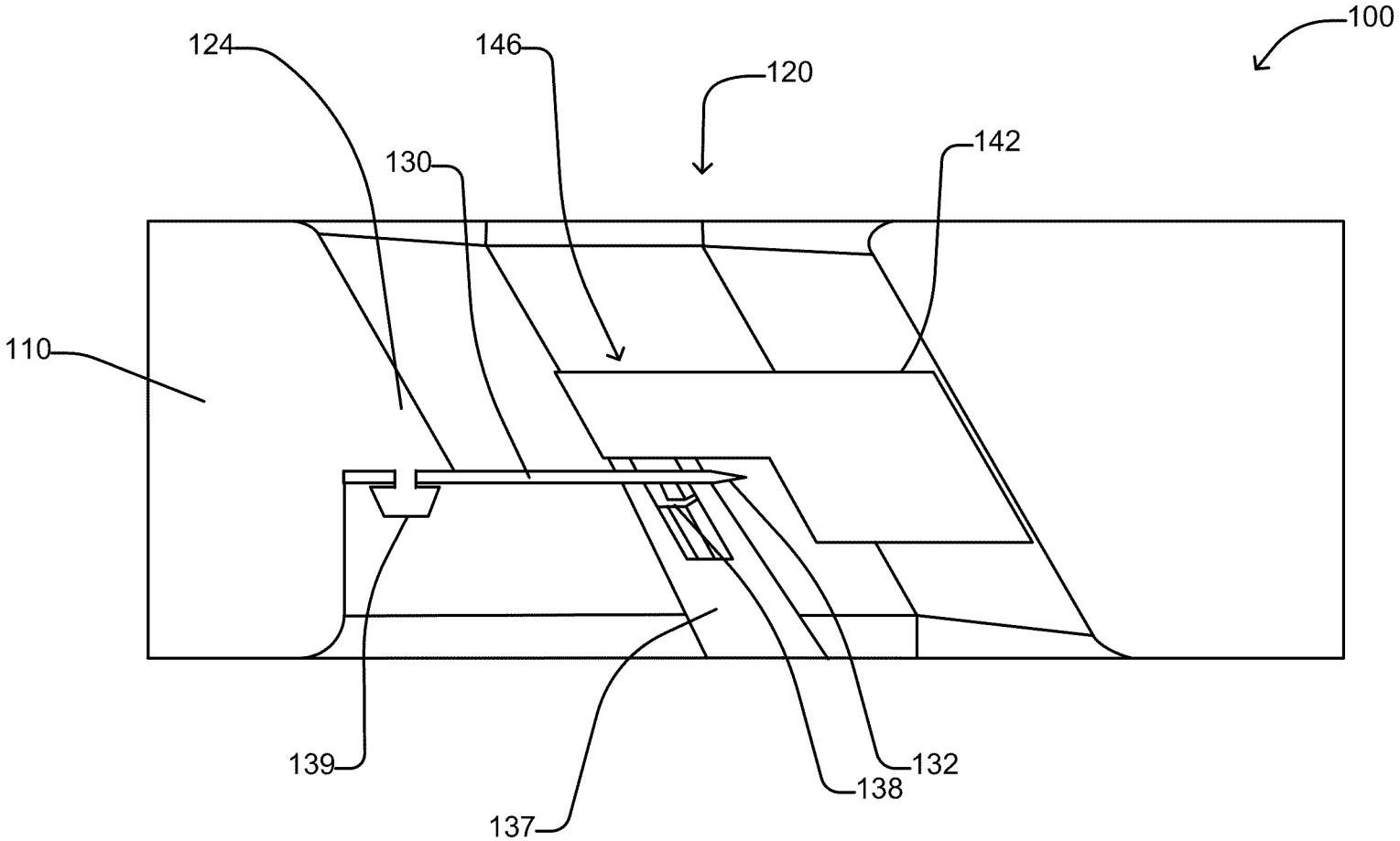
FIG. 4B is a sectional view taken along line A-A of FIG. 2 showing the blade connection mechanism of FIG. 3B.

FIGS. 3B and 4B illustrate an example connection mechanism wherein blade 130 is permanently held in place in aperture 120 by blade 130 is installed by tabs 138 and a stub 139. Stub 139 may be integrally formed with body 110. Stub 139 is configured to pass through a hole in blade 130 (not specifically enumerated) to locate blade 130 during installation. Once blade 130 is installed stub 139 may be manipulated such that it prevents or substantially hinders translational movement of blade 130. In some embodiments, an end of stub 139 is melted or otherwise deformed to create a rivet-like engagement between stub 139 and blade 130, as best seen in FIG. 4B. In other embodiments stub 139 may be manipulated by bending, cutting, deforming etc. to prevent or substantially hinder translational movement of blade 130. In other embodiments, locating stub 139 may form a friction or pressure fit with blade 130, possibly in combination with a slot such as slot 136. As one skilled in the art will appreciate, other blade connection mechanisms are also possible.

Figure 5A:
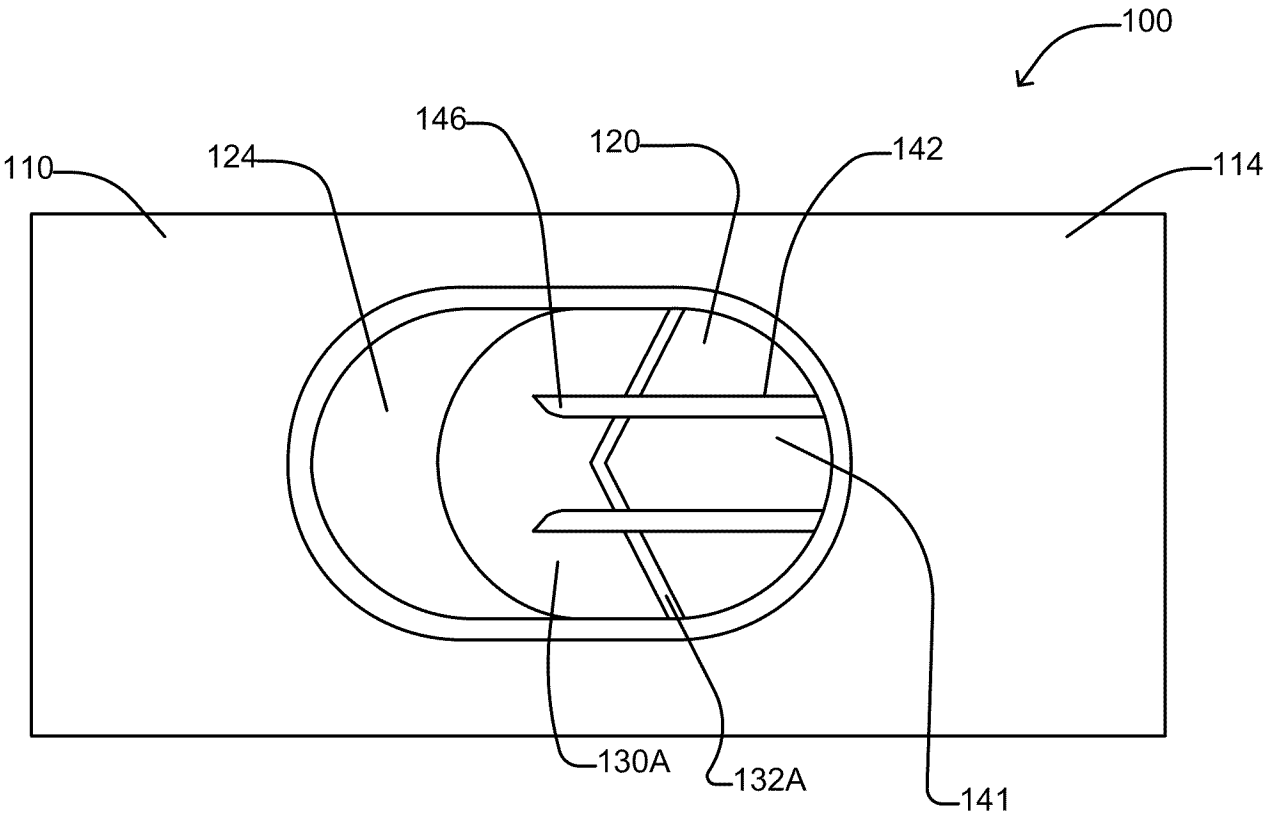
FIGS. 5A and 5B show example cutting tools with different blades.
Figure 5B:
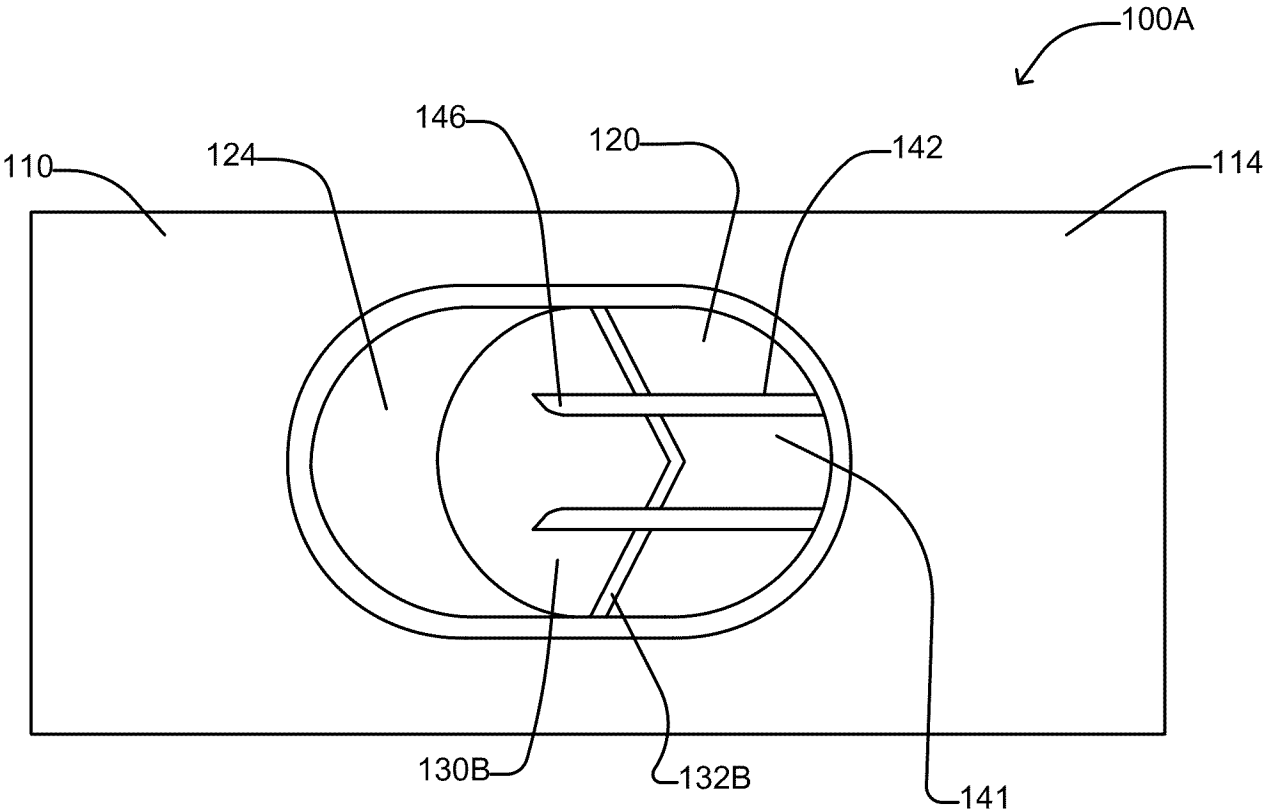

In the examples discussed above, blade 130 comprises a generally parallelogram-shaped razor-type blade having a straight cutting edge 132, but it is to be understood that different types of blades could also be provided. For example, FIGS. 5A and 5B show example cutting tools 100A and 100B having blades 130A and 130B, respectively. Blade 130A has a concave-type V-shaped cutting edge 132A, and blade 130B has a convex-type V-shaped cutting edge 132B. Other cutting means, such as overlapping blades, serrated cutting edges, etc. are also possible.

Figure 6:
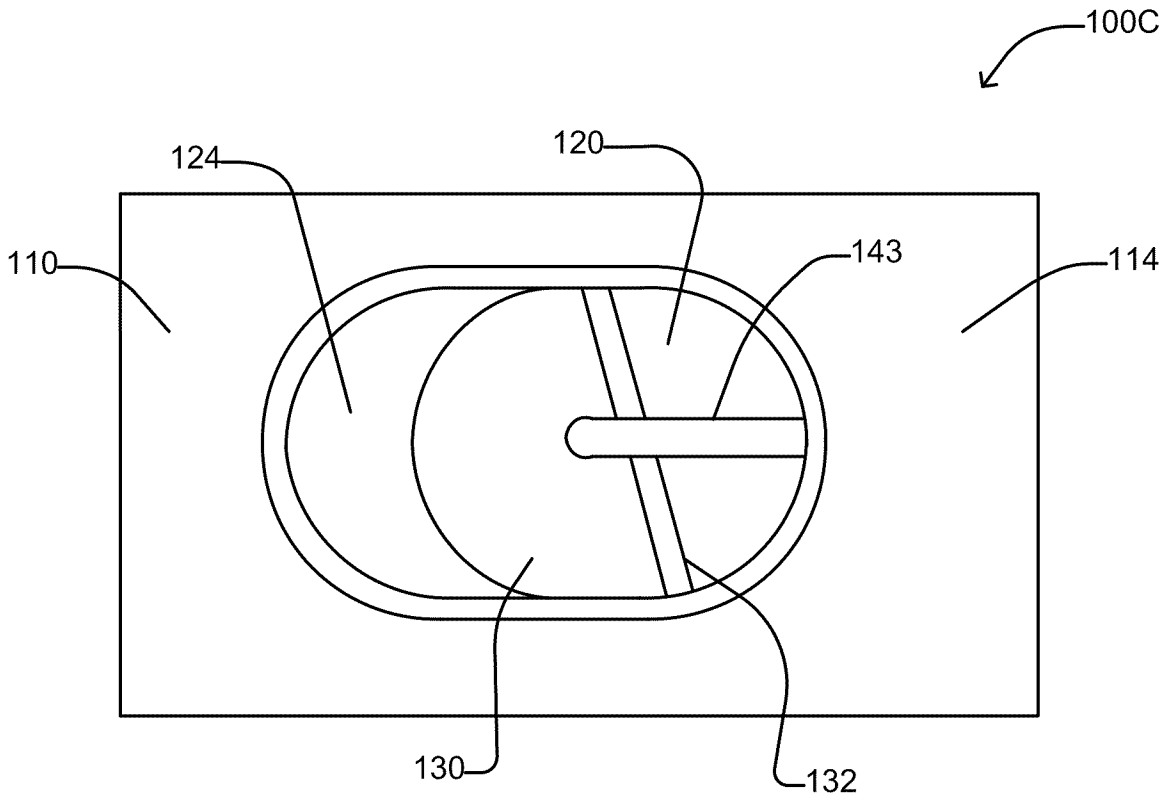
FIGS. 6 to 16 show example cutting tools with different types of blade protection means.

In the examples discussed above, protrusions 140 comprise a pair of generally parallel fins 142, but it is to be understood that different types of protrusions could also be provided. For example, FIG. 6 shows an example tool 100C comprising a single fin 143. Fin 143 may have a stepped profile at the end thereof proximate cutting edge 132. Fin 143 may be flexible and resilient, and may be integrally formed with body 110. Fin 143 is configured such that it blocks access to cutting edge 132 when in a rest state, and allows access to cutting edge 132 when in a flexed state.

Figure 7:
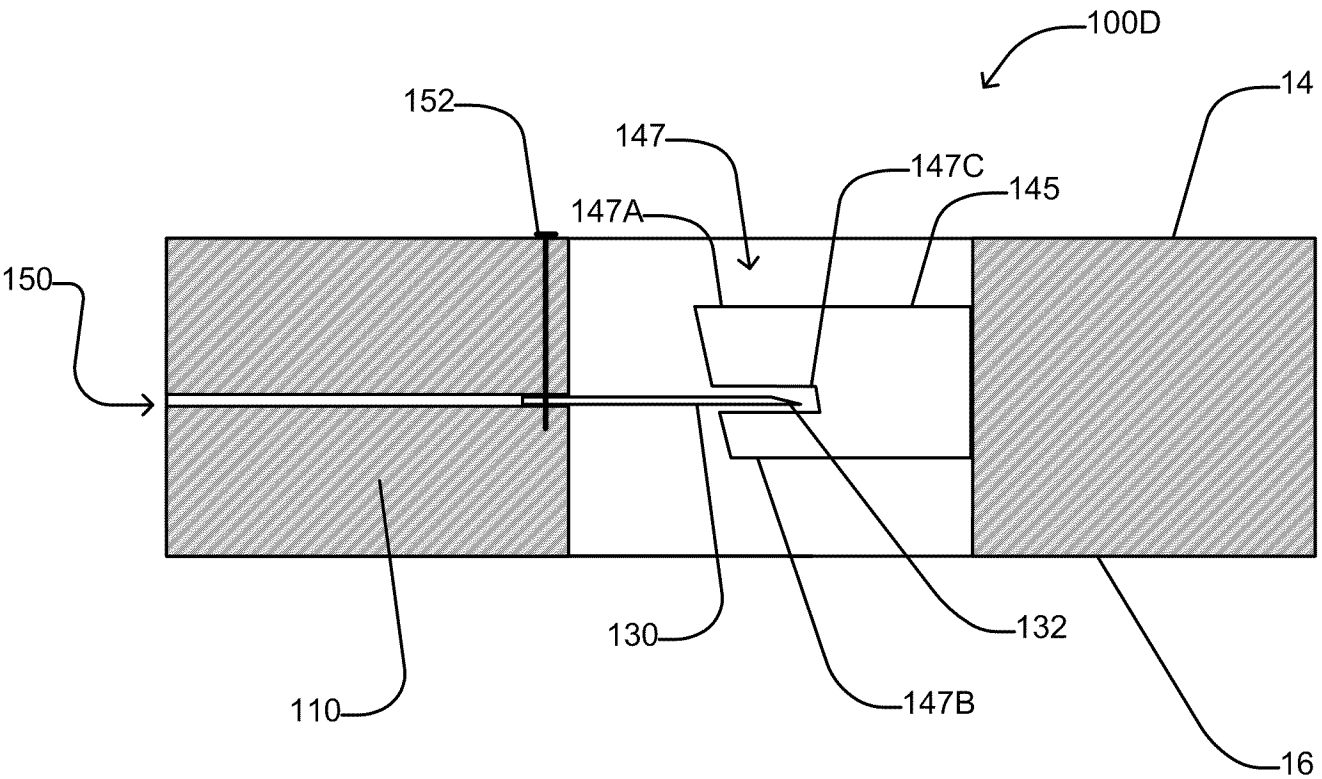

FIG. 7 schematically illustrates a sectional view of another example tool 100D having a different type of fin 145. Fin 145 may be used in place of fins 142 of the example of FIG. 1 or fin 143 of the example of FIG. 6. Fin 145 comprise an end portion 147 having a generally U-shaped profile which fits around cutting edge 132. End portion 147 comprises upper and lower portions 147A and 147B which extend past cutting edge 132 and a central portion 147C which ends short of cutting edge 132. Due to the configuration of fin 145, if blade is to be removable, blade 130 cannot simply be inserted from the bottom of tool 100D, but instead may be inserted through a passage 150 defined through body 110 and held in place by retaining means 152, which may comprise one or more screws, pins, or the like which engage blade 130 (typically either by passing through holes in blade or by pressing against blade 130). In the FIG. 7 example, passage 150 is shown extending from an end of body 110 through to communicate with aperture 120, but it is to be understood that passage 150 could alternatively be located in either side of body 110. As one skilled in the art will appreciate, if blade 130 is to be permanently mounted in aperture, a passage is not required, and blade 130 can be suitably positioned during forming of tool 100D, with tool body 110, fin(s) 145, and other features formed around blade 130 (for example, by injection molding).

Figure 8:
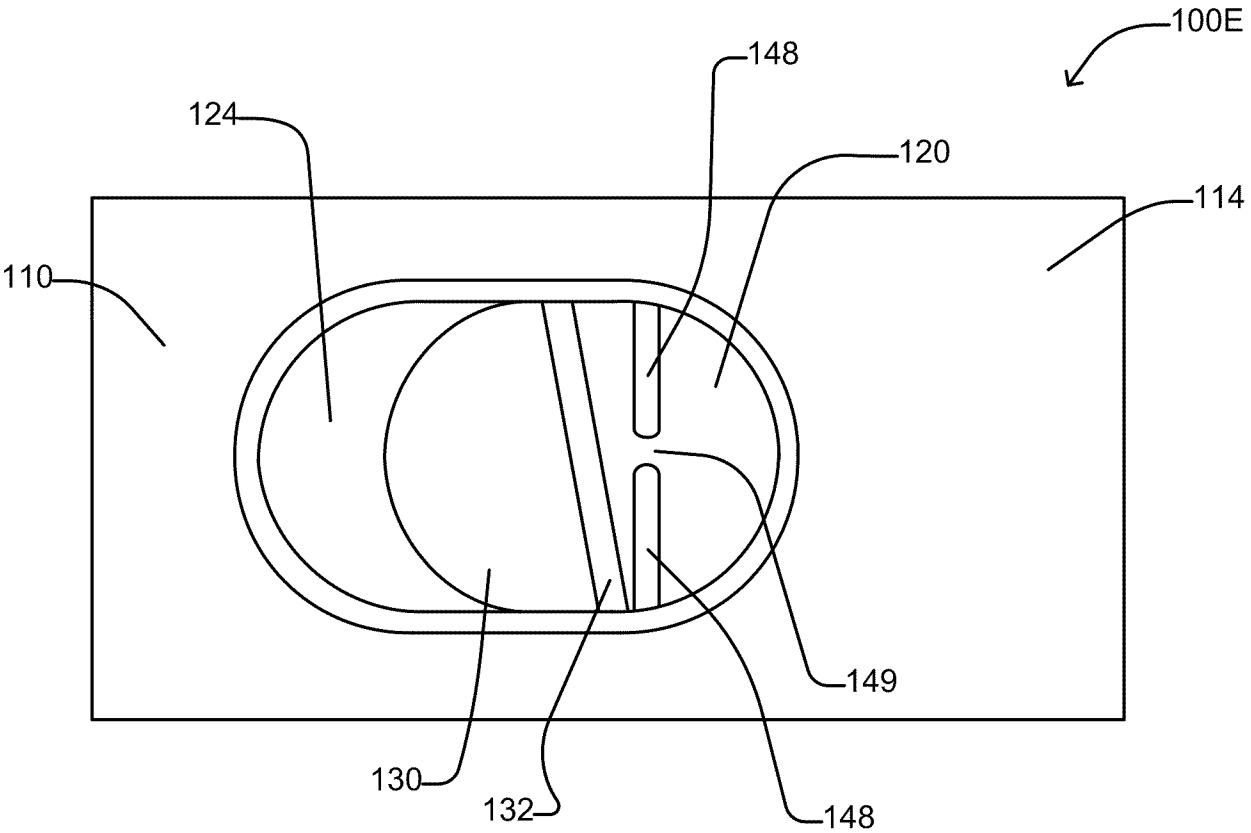

FIG. 8 shows another example tool 100E comprising a pair of laterally oriented fins 148 proximate to cutting edge 132. Fins 148 extend from opposite sides of aperture 120, and are oriented generally co-linearly and separated by a gap 149. In order to cut the end of a dispensing nozzle with tool 100E a user inserts the nozzle end through aperture 120 and forces the nozzle toward cutting edge 132. In the FIG. 8 embodiment, the resilient forces of fins 148 act against the engagement of the nozzle end with cutting edge 132 until a critical point is reached when fins 148 are flexed to a point at which gap 149 is large enough to permit the nozzle end to pass therethrough. At that point the immediate removal of the resilient forces of fins 148 facilitates a quick and clean removal of the nozzle end.

Figure 9:
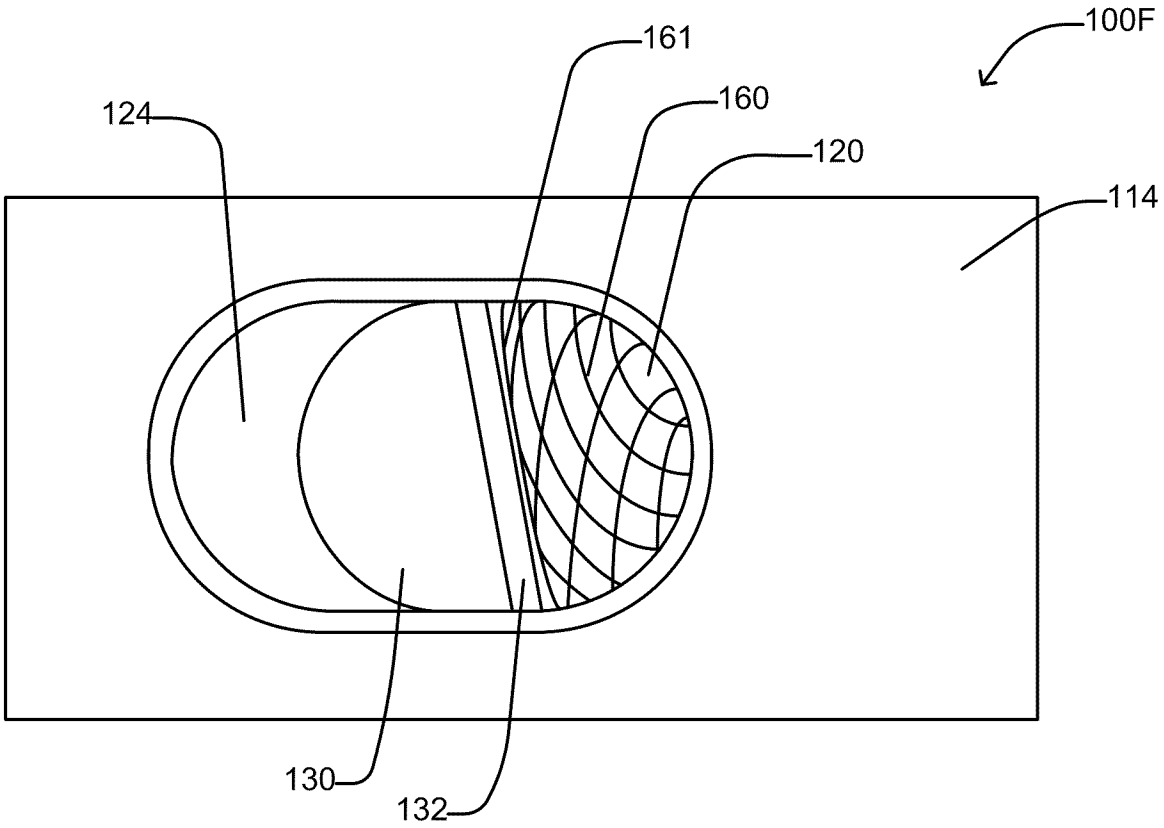

FIG. 9 shows another example tool 100F comprising a flexible mesh 160. Mech 160 has an end portion 161 located proximate to cutting edge 132. In order to cut the end of a dispensing nozzle with tool 100F a user inserts the nozzle end through aperture 120 and forces flexible mesh 160 away from cutting edge 132 such that the end of the nozzle can engage cutting edge 132.

Figure 10:
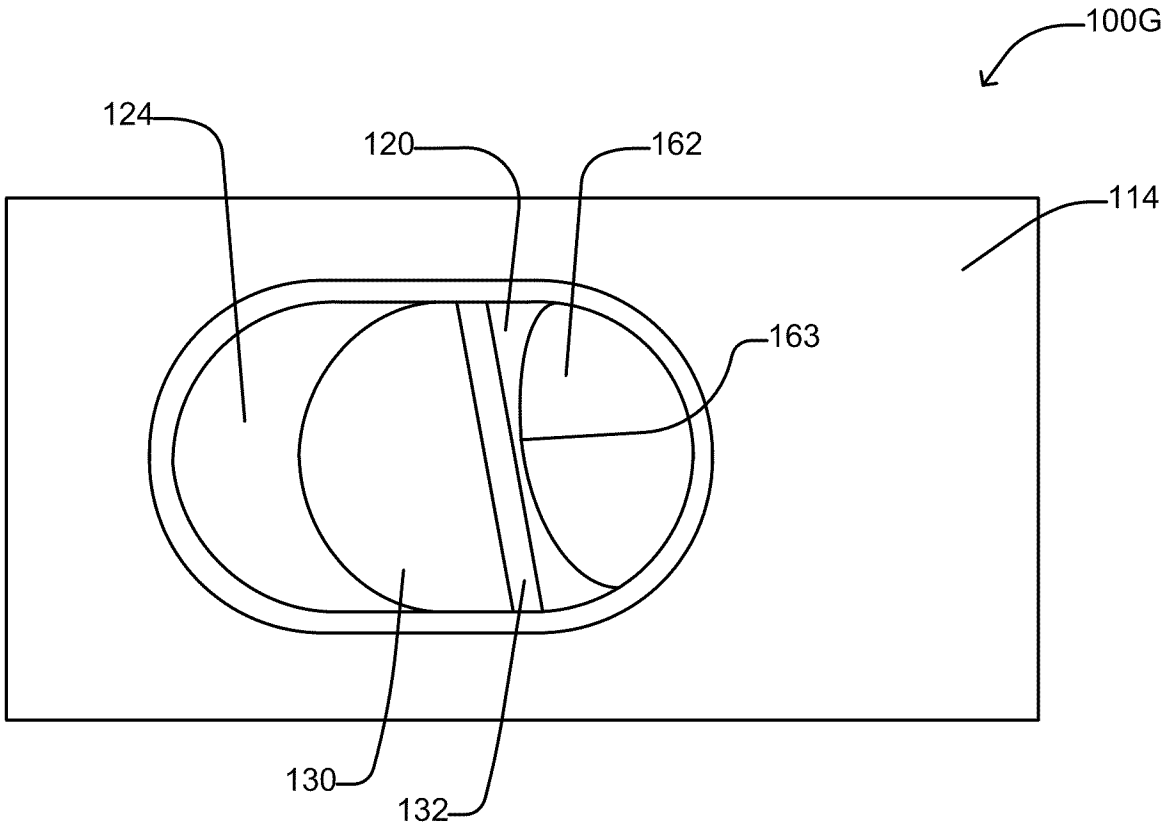
Figure 10A:
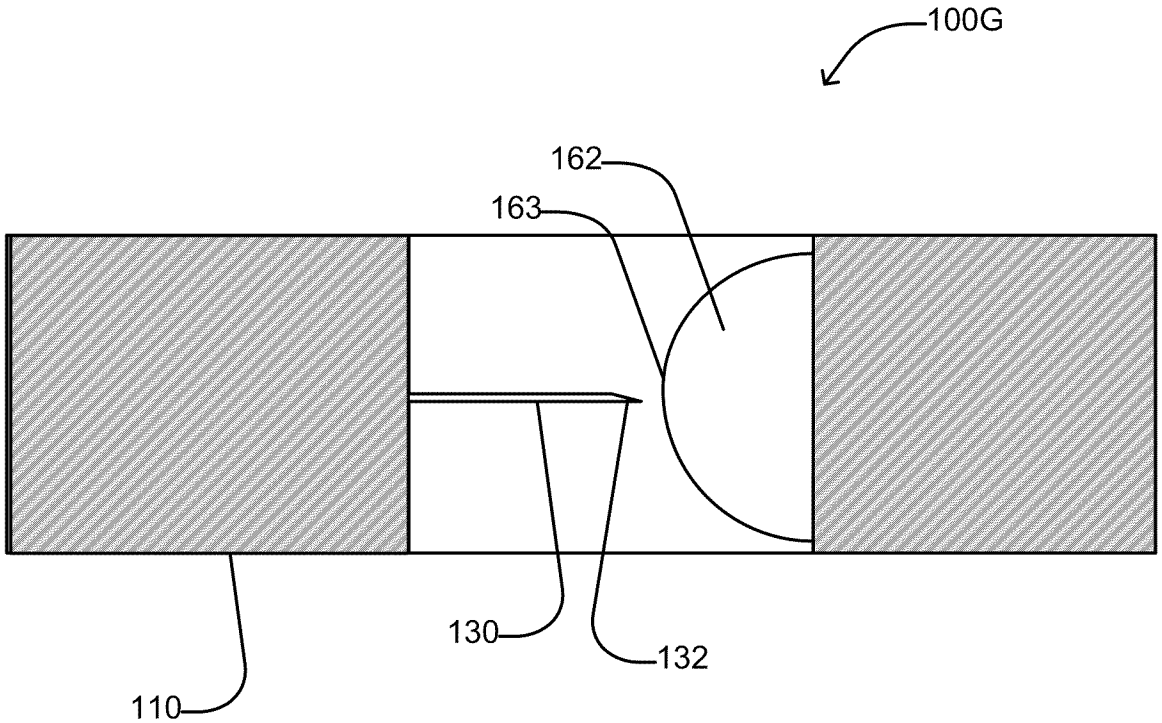

FIGS. 10 and 10A show another example tool 100G comprising a flexible bubble 162. Bubble 162 has an end portion 163 located proximate to cutting edge 132. In order to cut the end of a dispensing nozzle with tool 100G a user inserts the nozzle end such that flexible bubble 162 is deformed and the nozzle end can engage cutting edge 132. Flexible bubble 162 applies resilient force to the nozzle when flexed to assist a user to cut the nozzle end.

Figure 11:
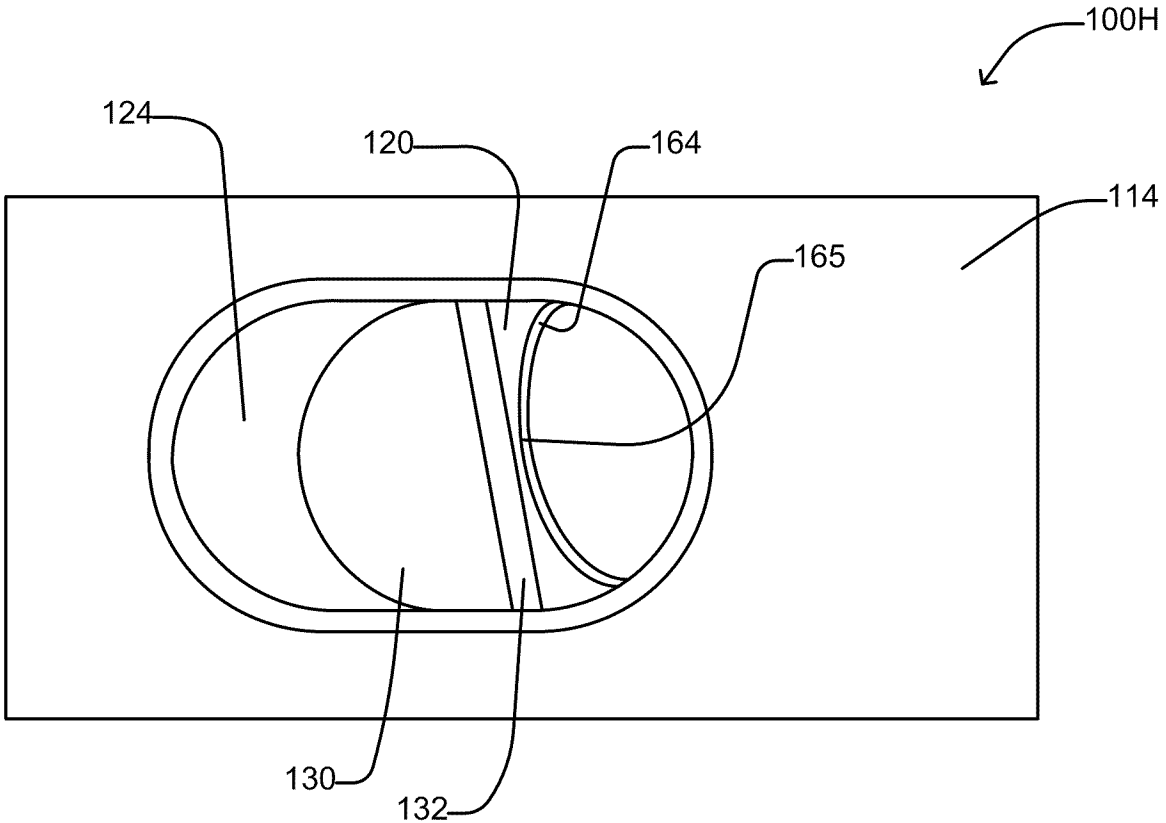

FIG. 11 shows another example tool 100H comprising a flexible curved strip 164. Strip 164 has an end portion 165 located proximate to cutting edge 132. A nozzle end may be inserted between strip 164 and cutting edge 132 such that strip 164 is flexed and the nozzle end may engage cutting edge 132. Strip 164 applies resilient force to the nozzle when flexed to assist a user to cut the nozzle end.

Figure 12:
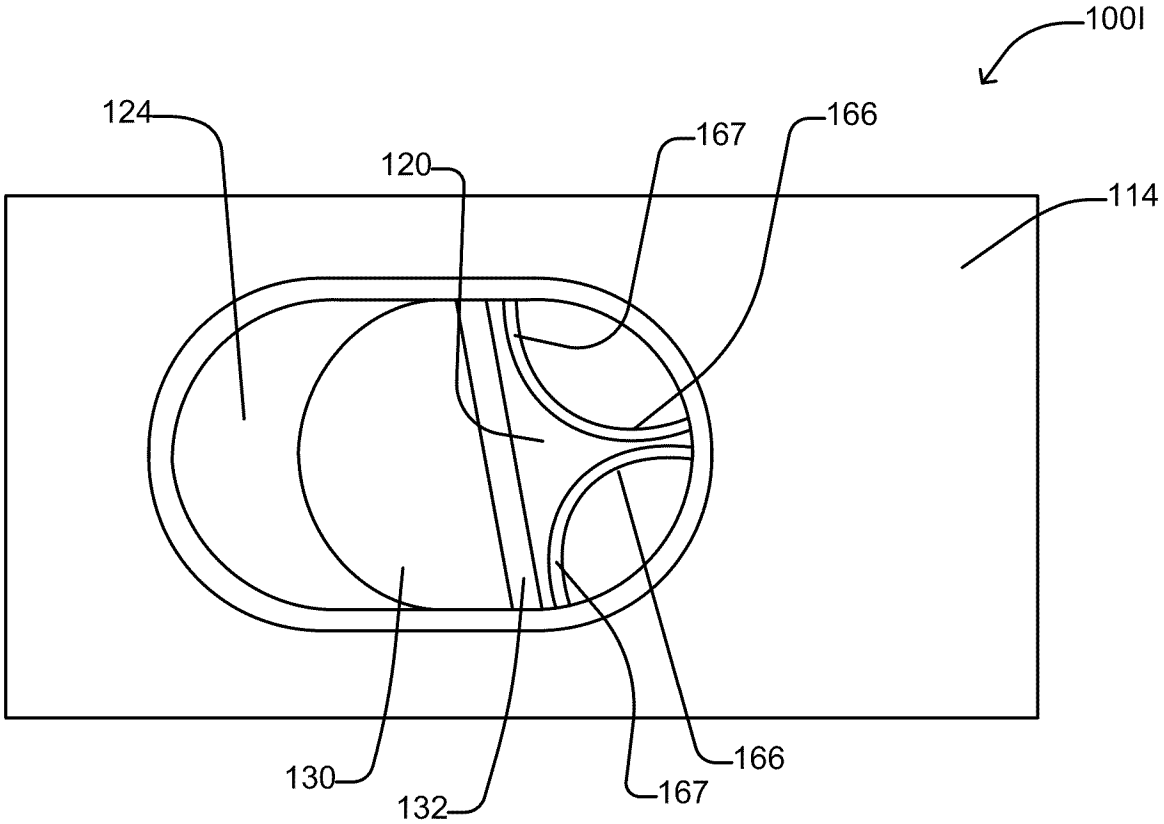

FIG. 12 shows another example tool 100I comprising dual flexible curved strips 166. Each strip 166 has an end portion 167 located proximate to cutting edge 132. A nozzle end may be inserted between strips 166 and cutting edge 132 such that strips 166 are flexed and the nozzle end may engage cutting edge 132. Strips 166 apply resilient force to the nozzle when flexed to assist a user to cut the nozzle end.

Figure 13:
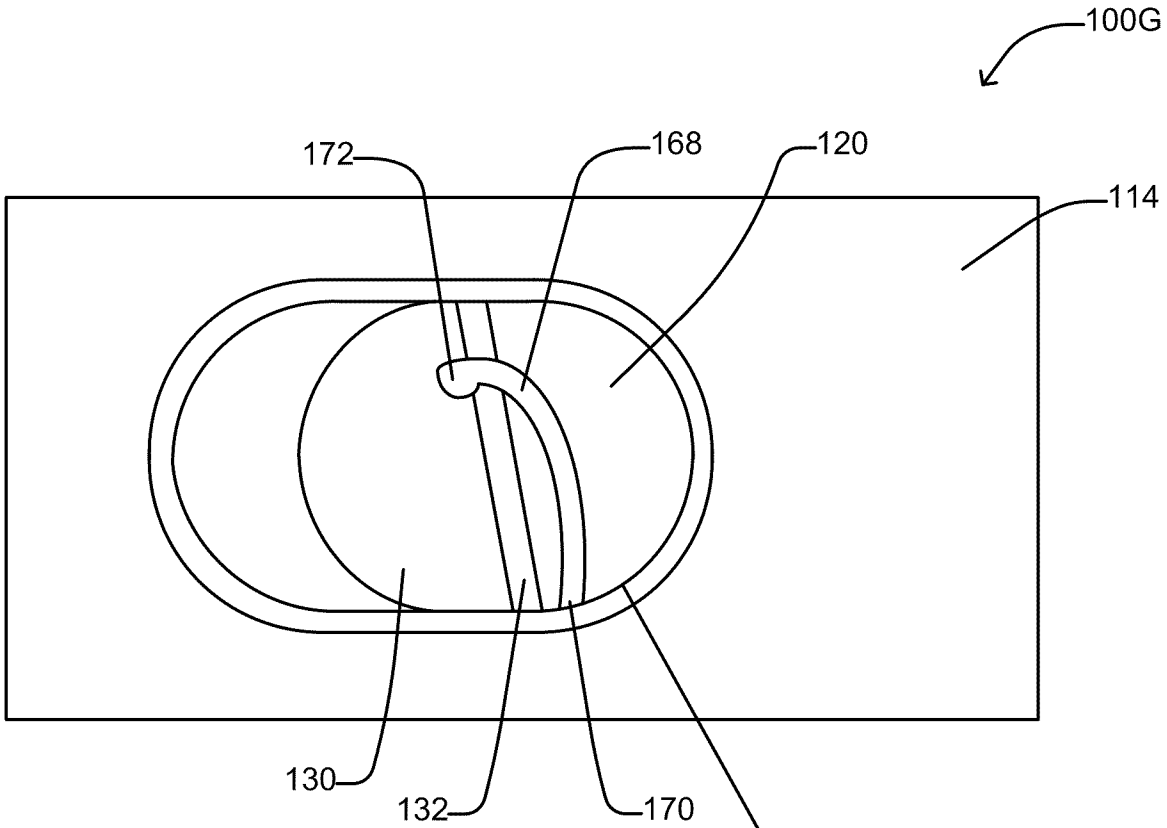

FIG. 13 shows another example tool 100J comprising a flexible hook 168. Hook 168 comprises an attached end 170 and an end portion 172 located proximate to cutting edge 132. Attached end 170 is connected to aperture wall 122. Hook 168 is moveable such that a nozzle end may be inserted between hook 168 and cutting edge 132. When the nozzle end is located to engage cutting edge 132, hook 168 may provide a resilient force assisting a user to cut the nozzle end.

Figure 14:
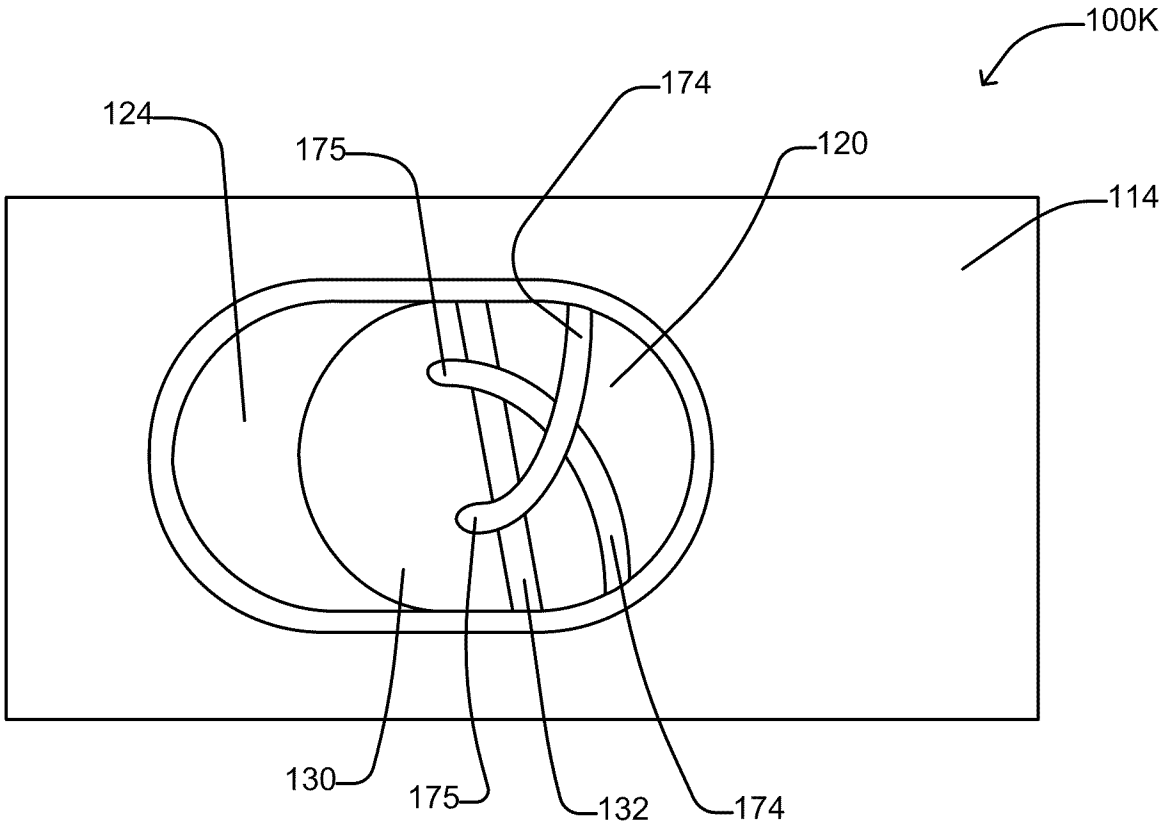

FIG. 14 shows another example tool 100K comprising a pair of flexible curved fins 174. Fins 174 are arranged in a crossing configuration. Each fin 174 comprises an end portion 175 located proximate to cutting edge 132. A nozzle end may be inserted between strips Fins 174 and cutting edge 132 such that fins 174 are flexed and the nozzle end may engage cutting edge 132. Fins 174 apply resilient force to the nozzle when flexed to assist a user to cut the nozzle end.

Figure 15:
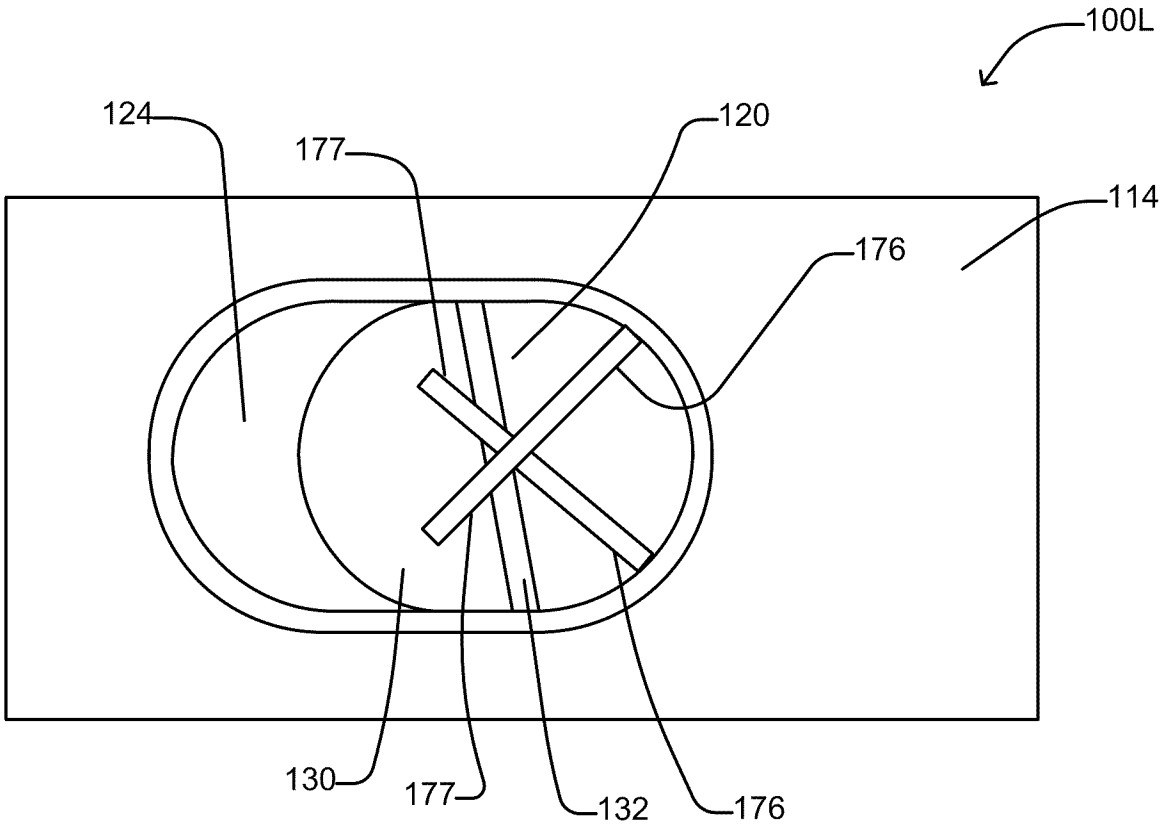

FIG. 15 shows another example tool 100L comprising a pair of flexible straight fins 176. Fins 176 are arranged in a crossing configuration.

Each fin 176 comprises an end portion 177 located proximate to cutting edge 132. A nozzle end may be inserted between strips Fins 176 and cutting edge 132 such that fins 176 are flexed and the nozzle end may engage cutting edge 132. Fins 176 apply resilient force to the nozzle when flexed to assist a user to cut the nozzle end.

Figure 16:
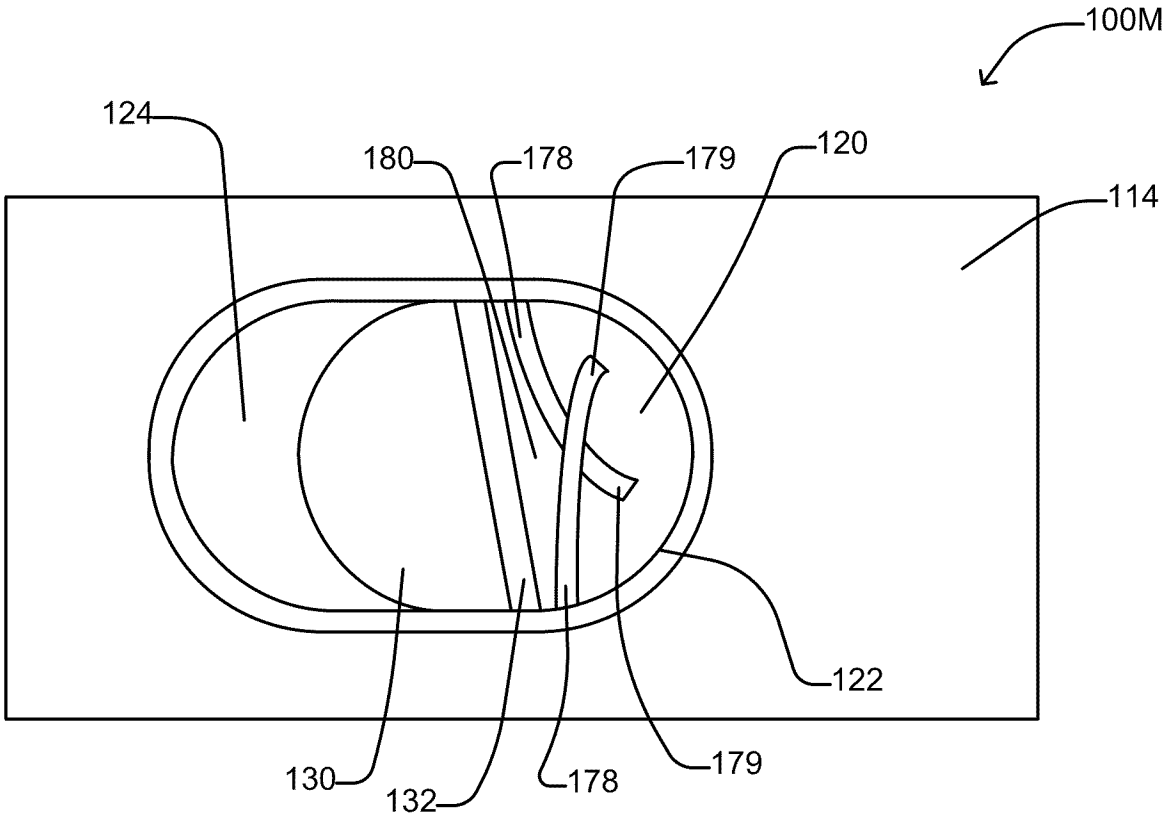

FIG. 16 shows another example tool 100M comprising flexible curved fins 178. Fins 178 are arranged in a crossing configuration, and are oppositely curved in comparison to fins 174 of the FIG. 14 example. Fins 178 each have an attached end (not specifically enumerated) attached to aperture wall 122 proximate to cutting edge 132. Fins 178 each have a free end 179. Free ends 179 are configured to abut aperture wall 122 when fins 178 are flexed and thereby restrict the size of a restricted space 180. Fins 178 may thus limit the size of restricted space 180 for receiving a nozzle, thereby limiting how far the nozzle end can be inserted into aperture 120 for cutting. Fins 178 therefore assist a user in achieving the precise and consistent removal of nozzle ends.

Figure 17:
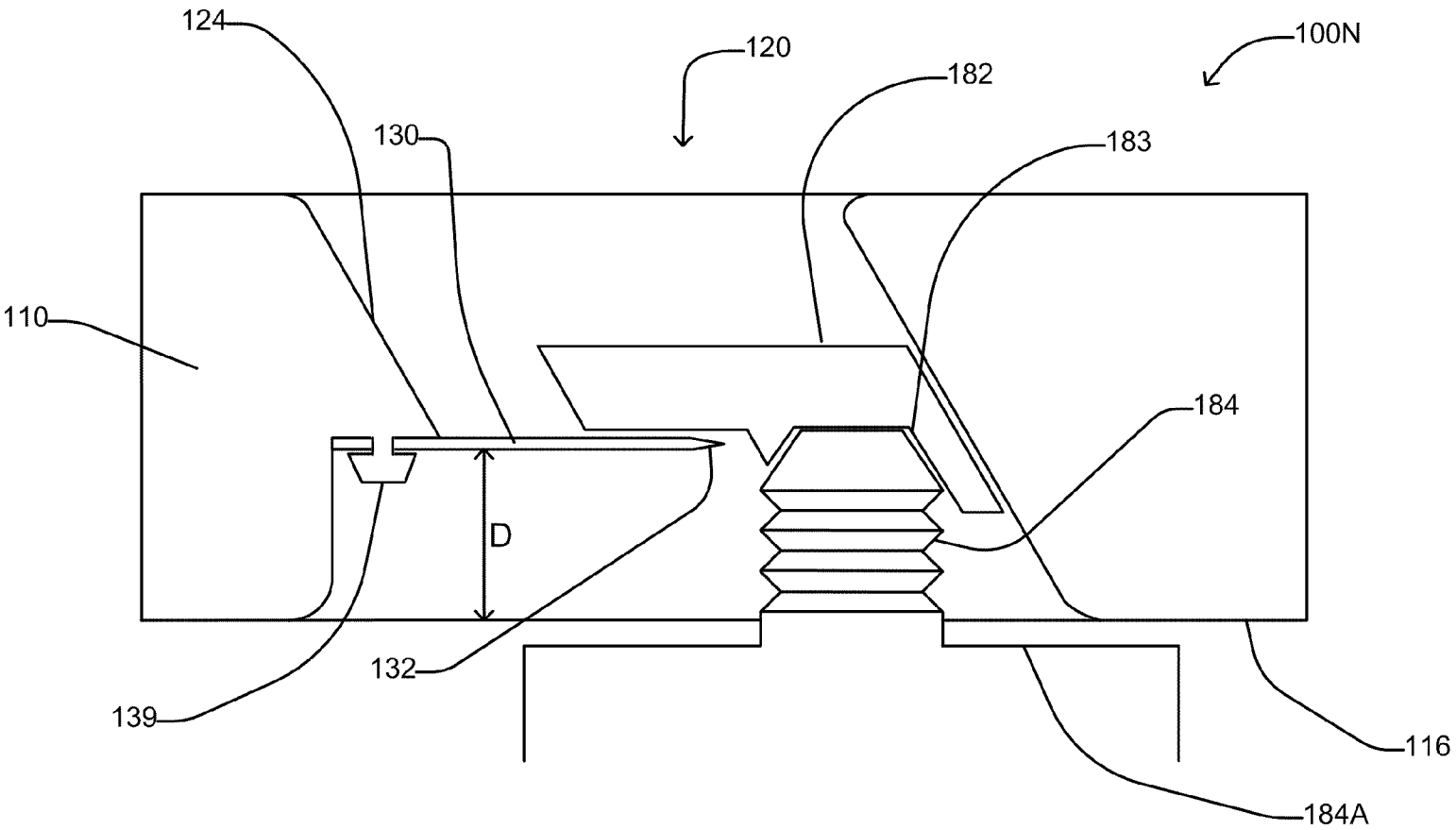
FIG. 17 illustrates use of an example tool for cutting a threaded dispenser end.

Some dispensers of curable material are designed with a sealed and threaded end such that the nozzles are separate from the dispenser and are threadedly attached to the threaded end after opening the seal. FIG. 17 shows another example tool 100N which may be used to effect a cut of such a sealed and threaded end. Tool 100N comprises multipurpose fins 182 that each have a cut out portion 183 configured to receive a sealed and threaded end 184 of a dispenser. Fins 182 may be spaced apart similarly to fins 142 of the FIG. 1 example. Threaded end 184 is inserted into aperture 120 from an underside thereof by the user and forces fins 182 apart to permit threaded end 184 to engage cutting edge 132. Blade 130 may be oriented generally parallel to bottom surface 116 of tool body 110 and separated from bottom surface 116 by a distance D selected such that when a dispenser body 184A abuts bottom surface 116 cutting edge 132 will be positioned to effect a cut at a desired location on threaded end 184.

Figures 17A, 17B:
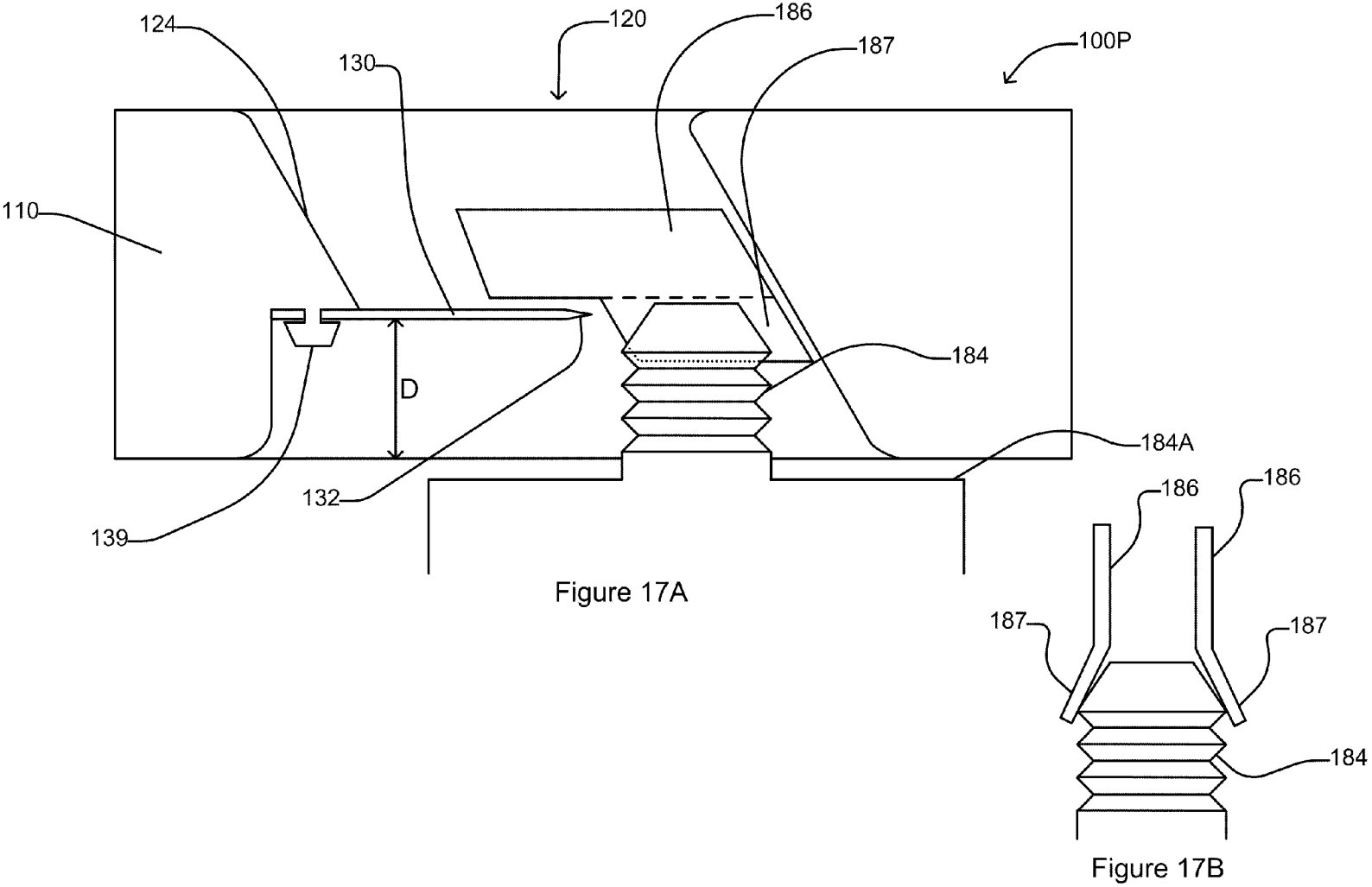
FIGS. 17A and 17B illustrates use of another example tool for cutting a threaded dispenser end.

FIGS. 17A and 17B show another example tool 100P similar to tool 100N of FIG. 17A, except that tool 100P comprises multipurpose fins 186 each having a flared bottom portion 187. As best seen in FIG. 17B (which shows an end view of fins 186 and threaded end 184 in isolation), flared bottom portions 187 are angled outwardly with respect to the upper portions of fins 186 in order to receive threaded end 184. Flared bottom portions may also be thinner than the upper portions of fins 186 in some embodiments to increase the flexibility thereof.

Cutting tools such as those described above may be combined with other tools which are useful for performing other functions to form a composite tool. In some embodiments, a composite tool may be provided which conveniently combines cutting with other functionalities related to working with curable materials such as sealants, caulking and adhesives, such that a user may often need only a single tool to complete various common tasks.

Figure 18:
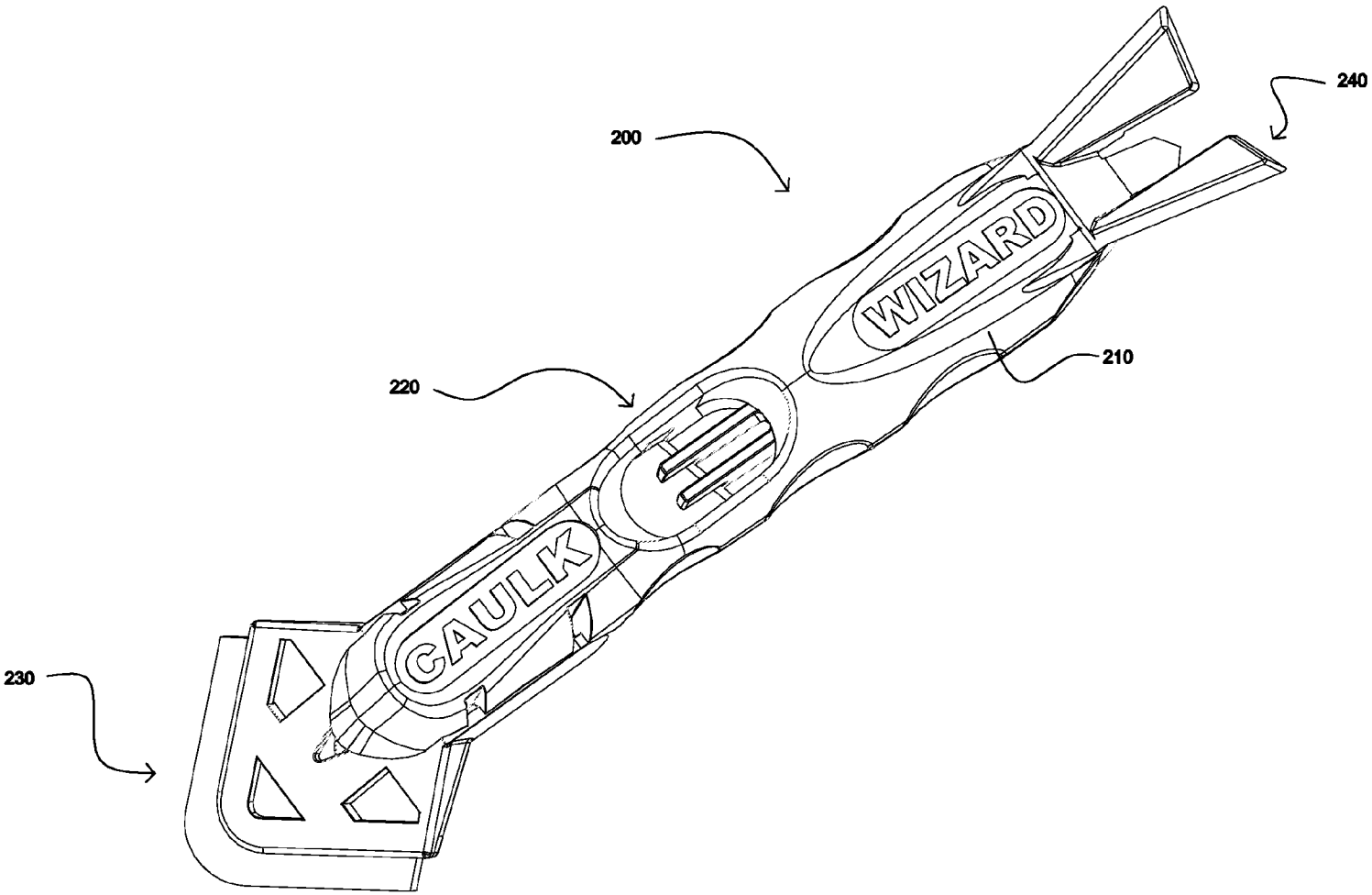
FIG. 18 is a perspective view of a compound tool comprising the cutting tool according to the example of FIG. 1.

FIG. 18 shows an example composite tool 200 according to one embodiment. Tool 200 comprises a tool body 210 in which a cutting tool 220 is provided. In the FIG. 9 example, cutting tool 220 is substantially similar to tool 100 as described above with respect to FIG. 1, but other configurations of cutting tool 200 are also possible. Tool 200 also comprises an applicator 230 at one end thereof and a plurality of scrapers 240 at an opposite end thereof. In some embodiments, applicator 230 is pivotally coupled to tool body 210 such that applicator 230 may be moved out of the way to expose an additional scraper (not shown). Other configurations of tool 200 are also possible.

While a number of exemplary aspects and embodiments have been discussed above, those of skill in the art will recognize certain modifications, permutations, additions and sub-combinations thereof. For example:

Other types of protrusions could also be provided to impede access to the cutting edge. For example, in some embodiments one or more flaps, meshes, tubes, flanges, posts etc. may be provided to impede access to the cutting edge.

In some embodiments each fin (or other protrusion) may be formed of a plurality of discrete elements which work together to impede access to the cutting edge.

It is therefore intended that the following appended claims and claims hereafter introduced are interpreted to include all such modifications, permutations, additions and sub-combinations as are within their true spirit and scope.

What is claimed is:

1. A cutting tool comprising:

a body;

an aperture formed through the body, wherein the aperture is defined by an inner surface of the body;

a blade coupled to the body, the blade having a cutting edge extending into the aperture; and, at least one protrusion extending from the body into the aperture, the at least one protrusion comprising at least one fin having a length oriented generally perpendicular to the cutting edge of the blade, the at least one protrusion having an end portion proximate the cutting edge, wherein the inner surface of the body and the at least one protrusion are configured to impede access to the cutting edge, wherein the at least one protrusion is configured to hold an end portion of a workpiece in engagement with the cutting edge when the workpiece is inserted into the aperture.

2. A cutting tool according to claim 1 wherein the at least one protrusion is formed of a flexible, resilient material.

3. A cutting tool according to claim 2 wherein the at least one protrusion is moveable between a rest state wherein access to the cutting edge is prevented and a flexed state wherein limited access to the cutting edge is permitted.

4. A cutting tool according to claim 1 wherein the at least one protrusion is integrally formed with the body.

5. A cutting tool according to claim 1 wherein the at least one protrusion comprises a pair of fins.

6. A cutting tool according to claim 5 wherein each of the pair of fins are oriented generally perpendicularly to a plane of the blade.

7. A cutting tool according to claim 6 wherein the aperture comprises first and second opposing ends, and wherein the blade extends into the aperture from the first end and the pair of fins extend into the aperture from the second end.

8. A cutting tool according to claim 7 wherein the pair of fins are formed of a flexible, resilient material and define an opening therebetween, the opening sized such that when the fins are in a rest state the fins block access to the cutting edge.

9. A cutting tool according to claim 8 wherein the fins are moveable into a flexed state by inserting the workpiece into the opening, wherein the workpiece is permitted to access the cutting edge when the fins are in the flexed state.

10. A cutting tool according to claim 9 wherein the fins exert a resilient force on the workpiece when in the flexed state such that the workpiece is urged toward the cutting edge.

11. A cutting tool according to claim 8 wherein each fin comprises a bottom portion adapted to receive a threaded dispenser end.

12. A cutting tool according to claim 1 wherein the blade is held in place by means of a slot defined in an end of the aperture and a pair of tabs on opposed side walls of the aperture.

13. A cutting tool according to claim 1 wherein the blade is held in place by means of a stub projecting through a hole in the blade.

14. A cutting tool according to claim 1 wherein the tool body comprises a handle.

15. A cutting tool according to claim 14 wherein the handle comprises a handle of a composite tool comprising one or more of an applicator for filler material and a scraper.

16. A cutting tool comprising:

a body;

an aperture formed within the body which is sized for receiving at least an end portion of a workpiece having a longitudinal axis, wherein the aperture is defined by an inner surface of the body;

a blade coupled to the body, the blade extending in a plane within the aperture and having a cutting edge at an end portion of the blade; and at least one protrusion extending from the body into the aperture, the at least one protrusion having a portion proximate the cutting edge, wherein the inner surface of the body and the at least one protrusion are configured to impede access to the cutting edge, wherein the protrusion is configured to permit insertion of the end portion of the workpiece into the aperture in an inserted orientation whereby the longitudinal axis of the workpiece intersects the plane of the cutting blade, wherein the end portion of the workpiece is positionable in the inserted orientation in contact with the cutting edge for severing a segment of the end portion from the remainder of the workpiece.

17. A cutting tool according to claim 16 wherein the at least one protrusion comprises one or more fins oriented at a non-perpendicular angle with respect to the blade.

18. A cutting tool according to claim 16 wherein the at least one protrusion comprises a pair of laterally oriented fins defining a gap therebetween.

19. A cutting tool according to claim 16 wherein the at least one protrusion comprises a pair of fins arranged in a crossing configuration.

20. A cutting tool according to claim 16 wherein the at least one protrusion comprises a flexible mesh.

21. A cutting tool according to claim 16 wherein the at least one protrusion comprises one or more flexible strips.

22. A cutting tool according to claim 16 wherein the at least one protrusion comprises a flexible hook.

23. A cutting tool according to claim 16 wherein the at least one protrusion comprises a flexible bubble.

24. A cutting tool according to claim 1, wherein the at least one protrusion urges the workpiece into engagement with the cutting edge of the blade when the workpiece is inserted into the aperture in order to facilitate an approximate transverse cut through the end portion of the workpiece.

25. A cutting tool according to claim 3, wherein the at least one protrusion overlies the cutting edge of the blade in the rest state and the flexed state.

26. A cutting tool according to claim 1, wherein the end portion of the at least one protrusion intersects the plane of the blade.

27. A cutting tool according to claim 1, wherein the aperture has a length and a width and wherein the cutting edge extends widthwise for engaging the end portion of the workpiece when the workpiece is inserted into the aperture.

28. A cutting tool according to claim 5, wherein each of the fins comprise a fixed end connected to the body at one end of the aperture in closely spaced-apart relation to the fixed end of the other one of the pair of fins.

29. A cutting tool comprising:

a body;

an aperture formed through the body, wherein the aperture is defined by an inner surface of the body;

a blade coupled to the body, the blade having a cutting edge extending into the aperture; and a pair of fins extending from the body into the aperture, each one of the pair of fins having a free end portion proximate the cutting edge, wherein the inner surface of the body and the at least one protrusion are configured to impede access to the cutting edge, wherein the aperture comprises first and second opposing ends, wherein the pair of fins each have a fixed end connected to said body at the second end of the aperture, wherein said fins extend from the second end of the aperture toward the first end of the aperture in spaced-apart, generally parallel planes when in a rest state.

30. A cutting tool comprising:

a body;

an aperture formed within the body, wherein the aperture is defined by an inner surface of the body, the inner surface having a first end and a second end and opposed sidewalls each extending from the first end to the second end;

a blade coupled to the body, the blade having a cutting edge extending transversely within the aperture between the opposed sidewalls part-way between the first and second ends; and at least one protrusion overlying the cutting blade to impede access thereto, the protrusion having a fixed end connected to the body at the second end and a free end located within the aperture between the cutting edge and the first end.

31. A cutting tool according to claim 30, wherein the opposed sidewalls extend in generally parallel planes.

32. A cutting tool according to claim 31, wherein the protrusion comprises a pair of fins, wherein the fins extend in parallel, spaced-apart planes generally parallel to the opposed sidewalls.

33. The cutting tool according to claim 30, adapted for receiving within the aperture a workpiece having a longitudinal axis, wherein the free end of each of the fins flexes outwardly toward a respective one of the sidewalls when the workpiece is inserted between the fins in an inserted orientation whereby the longitudinal axis of the workpiece extends at an angle generally perpendicular to the direction of the cutting edge, wherein the fins hold the workpiece in contact with the cutting edge in the inserted orientation.

34. The cutting tool according to claim 33, wherein the blade extends from the first end part-way toward the second end in a plane intersecting the longitudinal axis of the workpiece when the workpiece is in the inserted orientation.

35. The cutting tool according to claim 32, each one of the pair of fins having an end portion proximate the cutting edge and configured to impede access to the cutting edge, wherein the pair of fins extend from an aperture wall at the second end of the aperture toward the first end of the aperture and are generally parallel to one another when in a rest state.

36. A cutting tool according to claim 16 wherein the at least one protrusion comprises one or more curved fins.

37. A cutting tool according to claim 16, wherein in the inserted orientation the longitudinal axis of the workpiece extends in a plane generally perpendicular to the plane of the cutting blade.

38. A cutting tool according to claim 16, wherein the cutting edge extends between sidewalls of the aperture in a transverse direction, and wherein the longitudinal axis of the workpiece extends generally perpendicular to the transverse direction in the inserted orientation.

39. A cutting tool according to claim 38, wherein the at least one protrusion comprises a pair of spaced-apart fins movable between a rest state and a flexed state, wherein the fins are configured in the flexed state for engaging the end portion of the workpiece when the workpiece is in the inserted orientation, each of the fins having a fixed end connected to the body and a free end overlying the cutting blade, and wherein each of fins extends in a direction generally perpendicular to the transverse direction of the cutting edge in the rest position.

40. A cutting tool according to claim 39, wherein each of the fins extends in a direction generally perpendicular to the longitudinal axis of the workpiece when the workpiece is in the inserted orientation.

41. A cutting tool according to claim 40, wherein the fins urge the end portion of the workpiece in contact with the cutting edge of the blade when the workpiece is in the inserted orientation and the fins are in the flexed state.

42. A cutting tool comprising:

a body;

an aperture defined through the body;

a blade coupled to the body, the blade having a cutting edge extending into the aperture; and, at least one protrusion extending from the body into the aperture, the at least one protrusion comprising at least one fin having a length oriented generally perpendicular to the cutting edge of the blade, the at least one protrusion having an end portion proximate the cutting edge and configured to impede access to the cutting edge, wherein the at least one protrusion is configured to hold an end portion of a workpiece in engagement with the cutting edge when the workpiece is inserted into the aperture, wherein the tool body comprises a handle of a composite tool comprising one or more of an applicator for filler material and a scraper.

43. A cutting tool comprising:

a body;

an aperture defined through the body;

a blade coupled to the body, the blade having a cutting edge extending into the aperture; and, at least one protrusion extending from the body into the aperture, the at least one protrusion comprising at least one fin having a length oriented generally perpendicular to the cutting edge of the blade, the at least one protrusion having an end portion proximate the cutting edge and configured to impede access to the cutting edge, wherein the at least one protrusion is configured to hold an end portion of a workpiece in engagement with the cutting edge when the workpiece is inserted into the aperture, wherein the end portion of the at least one protrusion intersects the plane of the blade.

44. A cutting tool comprising:

a body;

an aperture defined within the body which is sized for receiving at least an end portion of a workpiece having a longitudinal axis, a blade coupled to the body, the blade extending in a plane within the aperture and having a cutting edge at an end portion of the blade; and at least one protrusion extending from the body into the aperture, the at least one protrusion having a portion proximate the cutting edge configured to impede access to the cutting edge, wherein the protrusion is configured to permit insertion of the end portion of the workpiece into the aperture in an inserted orientation whereby the longitudinal axis of the workpiece intersects the plane of the cutting blade, wherein the end portion of the workpiece is positionable in the inserted orientation in contact with the cutting edge for severing a segment of the end portion from the remainder of the workpiece, wherein the cutting edge extends between sidewalls of the aperture in a transverse direction, and wherein the longitudinal axis of the workpiece extends generally perpendicular to the transverse direction in the inserted orientation, wherein the at least one protrusion comprises a pair of spaced-apart fins movable between a rest state and a flexed state, wherein the fins are configured in the flexed state for engaging the end portion of the workpiece when the workpiece is in the inserted orientation, each of the fins having a fixed end connected to the body and a free end overlying the cutting blade, and wherein each of fins extends in a direction generally perpendicular to the transverse direction of the cutting edge in the rest position, wherein each of the fins extends in a direction generally perpendicular to the longitudinal axis of the workpiece when the workpiece is in the inserted orientation, and wherein the fins urge the end portion of the workpiece in contact with the cutting edge of the blade when the workpiece is in the inserted orientation and the fins are in the flexed state.

45. The cutting tool according to claim 1, wherein the body has a first surface extending in a first plane and a second surface extending in a second plane parallel to the first plane, wherein the aperture is formed between the first and second surfaces, wherein the workpiece has a longitudinal axis and wherein the at least one protrusion holds the end portion of the workpiece in engagement with the cutting edge when the workpiece is inserted into the aperture in an orientation whereby the longitudinal axis of the workpiece extends generally perpendicular to the first and second planes.

46. The cutting tool according to claim 1, wherein the inner surface of the body is continuous.

47. The cutting tool according to claim 1, wherein the inner surface of the body has a first end and a second end and opposed side surfaces each extending from the first end to the second end.

48. The cutting tool according to claim 1, wherein the inner surface of the body entirely surrounds the aperture.

49. The cutting tool according to claim 47, wherein the inner surface of the body is obround in shape.

* * * * *